US007027028B2

(12) United States Patent
Ishii

(10) Patent No.: US 7,027,028 B2
(45) Date of Patent: Apr. 11, 2006

(54) ELECTROOPTIC DEVICE, DRIVER CIRCUIT FOR ELECTROOPTIC DEVICE, AND ELECTRONIC EQUIPMENT

(75) Inventor: Kenya Ishii, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 369 days.

(21) Appl. No.: 10/390,683

(22) Filed: Mar. 19, 2003

(65) Prior Publication Data

US 2003/0218594 A1 Nov. 27, 2003

(30) Foreign Application Priority Data

Mar. 22, 2002 (JP) ..... 2002-081063
Jan. 30, 2003 (JP) ..... 2003-022025

(51) Int. Cl.
*G09G 3/36* (2006.01)

(52) U.S. Cl. ..... 345/98; 345/94; 345/96; 345/100; 345/204; 345/208; 345/209

(58) Field of Classification Search ..... 345/94, 345/96, 98, 100, 204, 208, 209
See application file for complete search history.

(56) References Cited

U.S. PATENT DOCUMENTS 5,952,854 A 9/1999 Kubota et al.
2001/0055010 A1* 12/2001 Kaise et al. ..... 345/204

FOREIGN PATENT DOCUMENTS

JP 01126628 A * 5/1989
JP A 1-126628 5/1989
JP 02304532 A * 12/1990
JP A 05-249499 9/1993
JP A 08-271931 10/1996
JP A-09-134970 5/1997
JP A 11-338434 12/1999
JP A 11-352464 12/1999
JP A 2000-098979 4/2000
JP A 2000-098982 4/2000
JP A 2001-249646 9/2001
WO WO 9963513 A2 * 12/1999

* cited by examiner

*Primary Examiner*—Sumati Lefkowitz
*Assistant Examiner*—Alexander S. Beck
(74) *Attorney, Agent, or Firm*—Oliff & Berridge, PLC

(57) ABSTRACT

An electrooptic device of the invention is constructed that an electrooptic substance is sandwiched between first and second substrates. The first substrate is overlaid with first displaying electrodes, switching elements which are disposed corresponding to the electrodes, data lines which are electrically connected with the switching elements, and a sampling circuit which includes first conductivity type transistors for sampling and which samples image signals and feeds them to the data lines, the image signals involving polarity inversion with respect to the center voltages of the amplitudes of these image signals. The electrooptic device further includes a gate voltage varying unit which changes the gate voltages of the first conductivity type transistors in response to the polarity inversion of the image signals. Thus, in an electrooptic device, such as a liquid crystal device in which inversion drive is implemented, flickering is reduced as the sampling circuit is constructed of the first conductivity type transistors.

12 Claims, 13 Drawing Sheets

ELECTROOPTIC DEVICE, DRIVER CIRCUIT FOR ELECTROOPTIC DEVICE, AND ELECTRONIC EQUIPMENT

BACKGROUND OF THE INVENTION

1. Field of Invention

The present invention relates to an electrooptic device, such as liquid crystal device. More particularly, the invention relates to an electrooptic device which includes a sampling circuit that samples image signals on image signal lines so as to feed the sampled signals to data lines laid in an image display region and which performs inversion drive. The invention further relates to a driver circuit which is well suited for application to such an electrooptic device, and an electronic equipment which includes such an electrooptic device.

2. Description of Related Art

An electrooptic device of the specified type can be constructed such that an element array substrate, which is formed with displaying electrodes, various wiring lines such as data lines, switching elements to switch pixels, such as thin film transistors (hereinbelow "TFTs") or thin film diodes (hereinbelow "TFDs"), etc., is arranged in opposition to an counter substrate, which is formed with a common electrode, formed over the whole surface of the substrate, scanning electrodes formed in the shape of stripes, color filters, light shield films, etc. An electrooptic substance, such as liquid crystal, is sandwiched in between the pair of substrates, and an image display region in which the displaying electrodes are arranged is located substantially centrally of the element array substrate (that is, on the region of the substrate facing the liquid crystal or the like).

A "built-in peripheral circuit type" of electrooptic device can also be provided in which peripheral circuits, such as a scanning line driver circuit, data line driver circuit, sampling circuit and inspection circuit, are built in the peripheral region of the element array substrate located around an image display region.

Among the peripheral circuits, the sampling circuit is constructed to include sampling switches formed of, for example, TFTs. The input side (for example, source side) of each sampling switch is connected to a corresponding image signal line laid in the peripheral region, while the output side (for example, drain side) thereof is connected to a corresponding data line laid in the image display region or its lead-out line. The sampling circuit is constructed so as to sample an image signal in response to a sampling circuit drive signal which is fed from a data line driver circuit to the control terminal (for example, gate) of each sampling switch, and to feed the sampled signal onto the data line.

On the other hand, in the electrooptic device of this type, an inversion drive scheme where the polarities of voltages to be applied to respective pixel electrodes are inverted with predetermined rules is adopted so as to prevent the deterioration of an electrooptic substance attributed to DC voltage application, and to prevent cross-talk or flickering of a displayed image.

The 1H inversion drive scheme is used as the inversion drive scheme, whose control is comparatively easy and which realizes an image display of high quality. During a display corresponding to the image signal of one frame or field, the pixel electrodes arrayed with odd-numbered rows are driven by a potential of positive polarity with respect to the potential of a common electrode, while the pixel electrodes arrayed with even-numbered rows are driven by a potential of negative polarity with respect to the potential of the common electrode, and during the subsequent display corresponding to the image signal of the next frame or field, contrary to the above, the pixel electrodes arrayed with the even-numbered rows are driven by a potential of positive polarity, while the pixel electrodes arrayed with the odd-numbered rows are driven by a potential of negative polarity (that is, the pixel electrodes of the same rows are driven by the potential of the identical polarity, and such a potential polarity is inverted in frame or field cycles for every row).

SUMMARY OF THE INVENTION

However, in a case where each of the sampling switches of the sampling circuit is constructed of a TFT of a first conductivity type and where the image signals involving the polarity inversion with respect to the center voltages of the amplitudes of these image signals are sampled for the inversion drive such as the 1H inversion drive stated above, the easiness of flow of source/drain currents are different from each other between the mode of sampling the image signals of positive polarity and the mode of sampling the image signals of negative polarity, assuming the gate voltage of each sampling switch is constant. More specifically, in case of employing the first conductivity type transistor of N-channel for the sampling circuit, the source/drain current of relatively large magnitude flows in the negative field, so that a write quantity increases. Conversely, the source/drain current of relatively small magnitude flows in the positive field, so that a write quantity decreases. Accordingly, voltages which are applied to the liquid crystal are different from each other between the negative field and the positive field, which causes the problem that flickering which conforms to a field frequency or an inversion drive frequency appears on a display screen.

There can be also a measure to counter the problem, in which each sampling switch is constructed of CMOS (Complementary MOS) type TFTs, to equalize the easiness of flow of source/drain currents between the positive field and the negative field. This measure, however, causes the problem that, when a pixel pitch is further fined at the request for a high definition, the layout of the sampling switches which are disposed in a one-to-one correspondence with the individual data lines becomes difficult. Likewise, a measure in which the flickering is reduced or suppressed by retention capacitors causes the problem that, when a pixel pitch is further fined, a region in which each retention capacitor is formed becomes smaller, so the layout of the retention capacitors becomes difficult.

The present invention addresses the above and/or other problems, and provides an electrooptic device which performs inversion drive, such as 1H inversion drive, and includes a sampling circuit and which can reduce flickering, a driver circuit for use in such an electrooptic device, and various electronic equipment each including such an electrooptic device.

The electrooptic device of the present invention includes an electrooptic substance which is sandwiched between the first and second substrates; first displaying electrodes which are disposed above the first substrate; switching elements which are disposed corresponding to said first displaying electrodes; data lines which are electrically connected to said switching elements; a sampling circuit which includes first conductivity type transistors to sample the image signals involving polarity inversion with respect to center voltages of amplitudes of said image signals and feed them to said data lines; a second displaying electrode which is disposed above the second substrate so as to oppose the first displaying electrodes; and a gate voltage varying unit which changes gate voltages of the first conductivity type transistors in response to the polarity inversion.

According to the electrooptic device of the present invention, during the operation thereof, the image signals fed onto an image signal line are sampled by the sampling circuit. In addition, the sampled image signals are fed to the data lines, and they are further fed to the first displaying electrodes, for example, pixel electrodes or striped-shaped electrodes, via the switching elements. On the other hand, the voltage of a common electrode potential, a common potential, a scanning signal potential or the like is applied to the second displaying electrode, for example, a whole-surface common electrode or stripe-shaped electrodes, at predetermined timings. Consequently, voltages corresponding to the image signals are applied to the electrooptic substance, such as a liquid crystal, which exists between the first and second displaying electrodes, whereby an electrooptic operation is performed. On this occasion, the image signals involve the polarity inversion, and the inversion drive, such as the 1H inversion drive stated before, is implemented. Thus, the deterioration of electrooptic substance, such as the liquid crystal, attributed to DC voltage application can be effectively reduced or avoided, and simultaneously flickering can be reduced or prevented.

In particular, the gate voltage varying unit changes the gate voltages of the first conductivity type transistors, which constitute the sampling circuit and which are used for sampling, that is, which serve as sampling switches in response to the polarity inversion. Therefore, even in a case where the sampling circuit is constructed of the first conductivity type transistors as in the present invention, the gate voltages are changed so that the easiness of flow of source/drain currents may be equalized on the higher potential side (namely, for the positive polarity) and the lower potential side (namely, for the negative polarity) of the image signals, which involve the polarity inversion with respect to the center voltages of the amplitudes of these image signals. In this way, the flickering can be reduced as compared with that in the case of the related art in which the gate voltages are fixed irrespective of the polarities as stated above.

By way of example, in case of an N-channel type transistor, the source/drain current is easier to flow for the negative polarity. It is therefore allowed to lower the writability of the transistor on the occasion of the negative polarity by making the gate voltage relatively small, and to heighten the writability on the occasion of the positive polarity by making the gate voltage relatively large.

On the other hand, in case of a P-channel type transistor, the source/drain current is easier to flow for the positive polarity. It is therefore allowed to lower the writability of the transistor on the occasion of the positive polarity by making the gate voltage relatively small, and to heighten the writability on the occasion of the negative polarity by making the gate voltage relatively large.

Moreover, respective sampling switches of such a sampling circuit are formed of the first conductivity type transistors. Therefore, even when the pitch of the data lines is narrowed by further fining a pixel pitch in compliance with a request for a high definition, so the pitch of the sampling switches held in a one-to-one correspondence with the data lines is narrowed, a planar layout affords a sufficient margin as compared with that in the case of the CMOS type as stated before.

As a result, the inversion drive such as 1H inversion drive can be favorably implemented while the high definition is attained, and moreover, an image display of high quality with reduced flickering becomes possible.

According to one aspect of the electrooptic device of the present invention, the gate voltage varying unit changes-over the gate voltages in response to the polarity inversion so as to equalize writabilities of the first conductivity type transistors for both a positive polarity of the image signals and a negative polarity of the image signals.

According to this aspect, the gate voltages are changed so that the writabilities of the first conductivity type transistors, namely, the easiness of flow of the source/drain currents thereof is equalized for both the positive polarity of the image signals involving the polarity inversion and the negative polarity thereof. It is therefore possible to reduce or maximally reduce the flickering ascribable to the difference of the writabilities which is attributed to the polarity inversion.

According to another aspect of the electrooptic device of the present invention, the first displaying electrodes include a plurality of pixel electrodes which are insularly disposed in pixel units; the data lines are electrically connected with the pixel electrodes via the corresponding switching elements; and the second displaying electrode is constructed of a common electrode which opposes to the plurality of pixel electrodes.

According to this aspect, the image signals sampled by the sampling circuit are written into the pixel electrodes via the data lines and the switching elements (for example, pixel switching TFTs), whereby active matrix drive becomes possible. It is accordingly permitted to present an image display of high quality which has a high contrast and in which flickering and cross-talk are reduced.

In this aspect, the electrooptic device may be so constructed that the plurality of pixel electrodes include a first group of pixel electrodes which are subjected to inversion drive in a first cycle, and a second group of pixel electrodes which are subjected to inversion drive in a second cycle complementary to the first cycle, and that they are planarly arrayed on the first substrate.

With such a construction, the inversion drive, for example, 1H inversion drive, 1S inversion drive or dot inversion drive, can be executed in the active matrix drive.

According to another aspect of the electrooptic device of the present invention, the sampling circuit is formed in the peripheral region of the first substrate which is located around an image display region where the first displaying electrodes are arranged; and a data line driver circuit which includes a shift register to feed sampling circuit drive signals to gates of the first conductivity type transistors is formed in the peripheral region.

According to this aspect, the sampling circuit drive signals can be outputted in a predetermined sequence from the shift register which is included in the data line driver circuit disposed in the peripheral region, whereby the plurality of first conductivity type transistors constituting the sampling circuit can be driven in the predetermined sequence.

In this aspect including the data line driver circuit, the electrooptic device may be so constructed that inverters, whose output sides are connected to the gates of said first conductivity type transistors, are further provided such that the sampling circuit drive signals are inputted to said gates via said inverters, and the gate voltage varying unit changes supply voltages of said inverters in response to the polarity inversion.

With such a construction, the supply voltages of the inverters are changed in response to the polarity inversion of the image signals by the gate voltage varying unit, whereby those gate voltages of the first conductivity type transistors which are output voltages from the inverters can be changed. That is, even in the case where the sampling circuit is constructed of the first conductivity type transistors, the supply voltages of the inverters are changed so that the easiness of flow of source/drain currents may be equalized for both the positive polarity of the image signals involving the polarity inversion and the negative polarity thereof, whereby flickering can be reduced.

In a case where each of the inverters is constructed of, for example, a CMOS type transistors, a clock signal whose voltage changes with a predetermined amplitude may be applied to the source of the P-channel type transistor portion thereof.

Alternatively, in this aspect including the data line driver circuit, the electrooptic device may be so constructed that transmission gates, whose output sides are connected to the gates of said first conductivity type transistors, are further provided such that the sampling circuit drive signals are inputted to gate control terminals of said transmission gates, and the gate voltage varying unit feeds input sides of said transmission gates with voltages which vary in response to the polarity inversion.

With such a construction, output voltages from the transmission gates are inputted to the gates of the first conductivity type transistors at the timing of the sampling circuit drive signals. On this occasion, the voltages which vary in response to the polarity inversion of the image signals (for example, two voltages which are prepared for the positive polarity and for the negative polarity) are fed to the input sides of the transmission gates by the gate voltage varying unit, whereby the gate voltages of the first conductivity type transistors which are the output voltages from the transmission gates can be changed. That is, even in the case where the sampling circuit is constructed of the first conductivity type transistors, the input voltages to the transmission gates are changed so that the easiness of flow of source/drain currents may be equalized for both the positive polarity of the image signals involving the polarity inversion and the negative polarity thereof, whereby flickering can be reduced.

Alternatively, in this aspect comprising the data line driver circuit, the electrooptic device may be so constructed that said gate voltage varying unit includes a plurality of transmission gates whose output side is connected to the gate of the corresponding first conductivity type transistor and whose gate control terminals are fed with the sampling circuit drive signals, and that one of many differing supply voltages is selected by the plurality of transmission gates so as to be fed as the gate voltage of the corresponding first conductivity type transistor.

With such a construction, output voltages from the transmission gates are inputted to the gates of the first conductivity type transistors at the timings of the sampling circuit drive signals. On this occasion, one of many differing supply voltages is selected by the plurality of transmission gates so as to feed the selected supply voltage as the gate voltage of the corresponding first conductivity type transistor. Therefore, any one of the plurality of supply voltages (for example, two voltages which are prepared for the positive polarity and for the negative polarity) is selected in response to the polarity inversion of the image signals, whereby those gate voltages of the first conductivity type transistors which are the output voltages from the transmission gates can be changed. That is, even in the case where the sampling circuit is constructed of the first conductivity type transistors, the supply voltages are selected so that the easiness of flow of source/drain currents may be equalized for both the positive polarity of the image signals involving the polarity inversion and the negative polarity thereof, whereby flickering can be reduced.

Especially when a clock of high voltage is employed, an IC to supply voltages can become expensive. In contrast, with the above construction, the clock of high voltage can be obviated, and costs can be reduced.

In this case, the electrooptic device may be so constructed that one of many differing supply voltages is fed as being shared with a supply voltage for the data line driver circuit, while another is fed via an external circuit connection terminal of the electrooptic device and a wiring line connected thereto.

With such a construction, the number of dedicated supply voltages which are required to vary the gate voltages of the first conductivity type transistors can be made to be smaller. By way of example, one supply voltage suffices in addition to the supply voltage for the data line driver circuit. Therefore, increases in the number of external circuit connection terminals and the number of wiring lines connected thereto can also be reduced or suppressed.

In the above aspect including the data line driver circuit, the electrooptic device may be so constructed that the same sampling circuit drive signals are fed in parallel to the gates of a plurality, (n) such first conductivity type transistors for every group which includes a predetermined number (m), (a natural number of at least 2 and less than n) of first conductivity type transistors.

With such a construction, data line groups including a plurality of data lines are simultaneously driven by so-called "serial-to-parallel conversion". (As compared with the number of data lines, that is, the number of the first conductivity type transistors acting as the sampling switches, the number of the inverters or the transmission gates to variably feed the gate voltages of the transistors is especially decreased to 1/m. Accordingly, while the first conductivity type transistors each having a comparatively simple construction are formed at a pixel pitch, the inverters or transmission gates, each having a comparatively complicated construction, may be formed with a pitch equal to 1/m of the pixel pitch. As a result, a circuit layout can be designed with a margin, and this is very advantageous in practice.

In order to accomplish the above, a driver circuit of the present invention is provided for an electrooptic device that includes an electrooptic substance which is sandwiched between first and second substrates; first displaying electrodes which are disposed above the first substrate; switching elements which are disposed corresponding to the first displaying electrodes; data lines which are electrically connected to the switching elements; and a second displaying electrode which is disposed above the second substrate so as to oppose the first displaying electrodes. The driver circuit includes a sampling circuit which includes first conductivity type transistors to sample the image signals involving polarity inversion with respect to center voltages of amplitudes of the image signals and feed them to the data lines; and a gate voltage varying unit which changes gate voltages of the first conductivity type transistors in response to the polarity inversion.

According to the driver circuit of the present invention for the electrooptic device, during the operation thereof, the image signals fed onto an image signal line are sampled by the sampling circuit. The sampled image signals are fed to the data lines, and they are further fed to the first displaying electrodes via the switching elements. On the other hand, the voltage of a common electrode potential or the like is applied to the second displaying electrode at predetermined timings. Consequently, voltages corresponding to the image signals are applied to the electrooptic substance, such as a liquid crystal, which exists between the first and second displaying electrodes, whereby an electrooptic operation is performed. In particular, the gate voltage varying unit especially changes the gate voltages of the first conductivity type transistors which constitute the sampling circuit in response to the polarity inversion. Therefore, even in a case where the sampling circuit is constructed of the first conductivity type transistors as in the present invention, the gate voltages are changed so that the easiness of flow of source/drain currents may be equalized on the higher potential side (namely, for the positive polarity) and the lower potential side (namely, for the negative polarity) of the image signals which involve the polarity inversion with respect to the center voltages of the amplitudes of these image signals, whereby the flickering can be reduced as compared with that in the case of the related art in which the gate voltages are fixed irrespective of the polarities as stated before.

As a result, the inversion drive, such as 1H inversion drive, can be favorably implemented while a high definition is attained, and moreover, an image display of high quality with reduced flickering becomes possible.

Also in the driver circuit of the present invention for an electrooptic device, various aspects similar to those concerning the electrooptic device of the present invention as stated above can be adopted.

In order to address or accomplish the above, the electronic equipment of the present invention includes the electrooptic device of the present invention (including the various aspects thereof) as stated above.

The electronic equipment of the present invention is constructed so as to incorporate the electrooptic device of the present invention as stated above. It is therefore possible to realize various electronic equipment capable of image displays of high quality, such as a projection type display apparatus, a liquid crystal TV receiver, a portable telephone, an electronic notebook, a word processor, a video tape recorder of view finder type or monitor direct view type, a workstation, a video telephone, a POS terminal and a touch panel, for example.

Such functions and other advantages of the present invention will be understood from exemplary embodiments described below.

DETAILED DESCRIPTION OF PREFERRED EMBODIMENTS

Exemplary embodiments of the present invention are described below in conjunction with the drawings. Each of the exemplary embodiments described below is such that the electrooptic device of the present invention is applied to a liquid crystal device.

(First Exemplary Embodiment)

Figure 1:
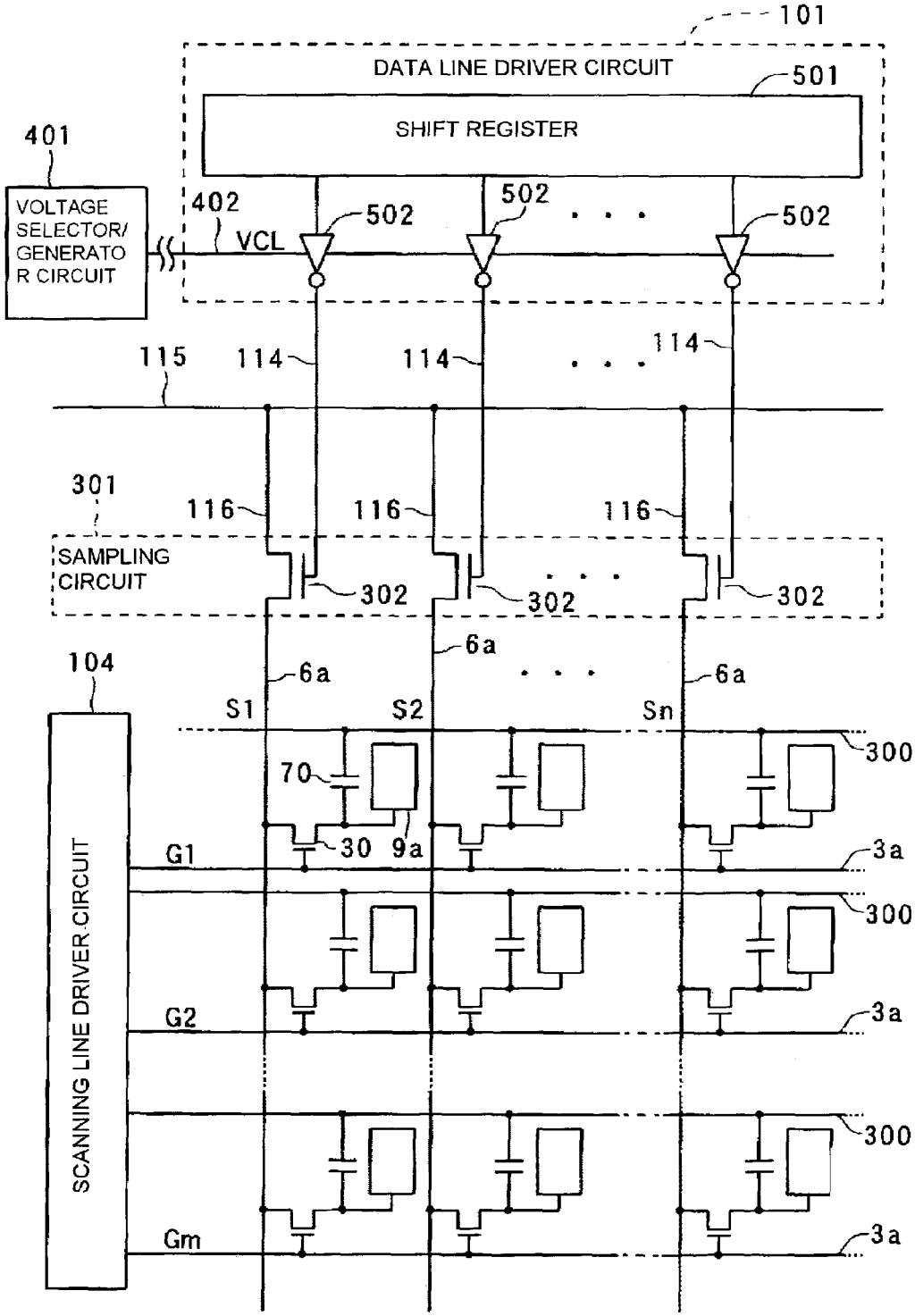
FIG. 1 is a circuit diagram in which an equivalent circuit of various elements, wiring lines, etc. disposed in a plurality of matrix-shaped pixels that constitute an image display region in an exemplary embodiment concerning the electrooptic device of the present invention are shown together with the peripheral driver circuits thereof.
Figure 3:
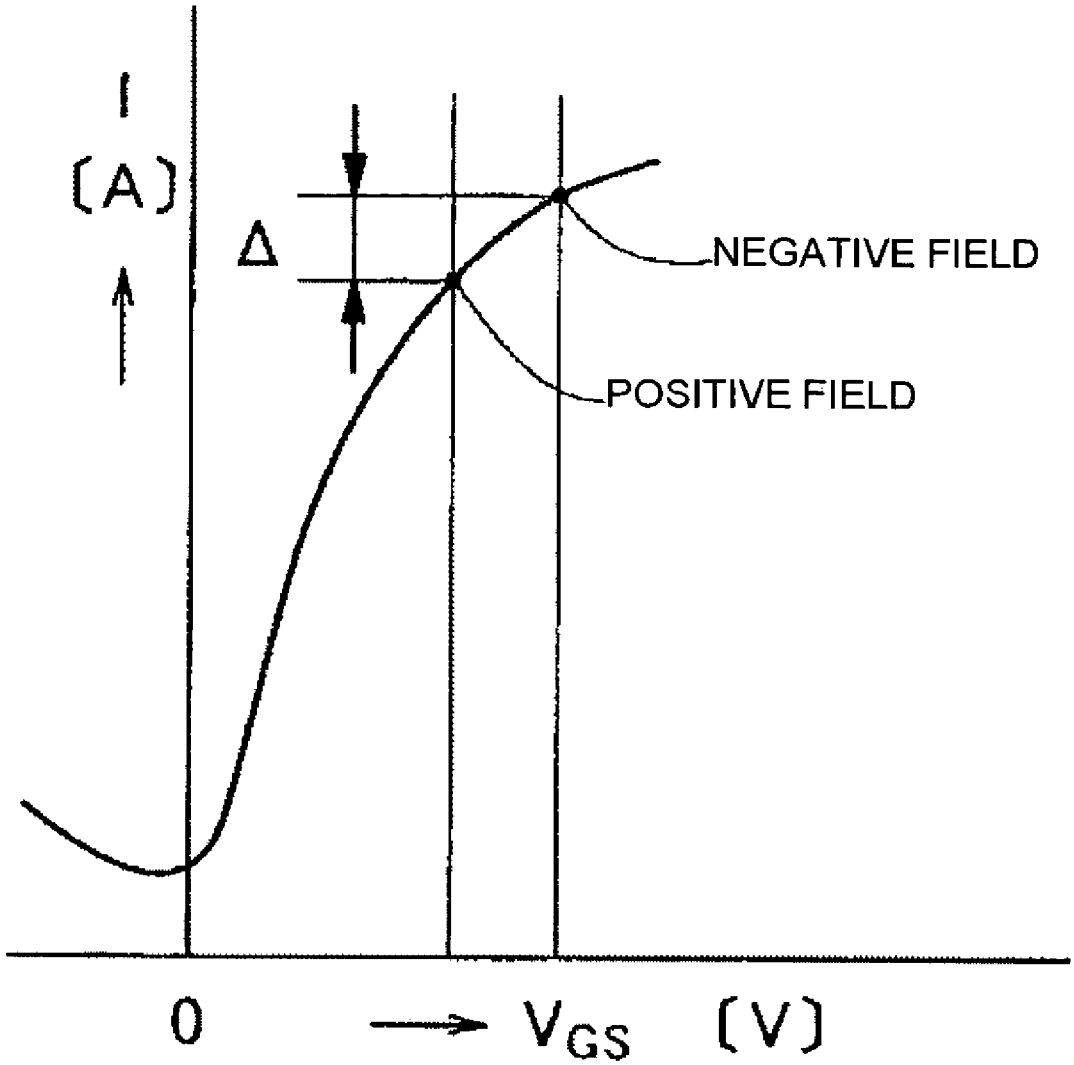
FIG. 3 is a graph showing the writability characteristic of a TFT of first conductivity type included in the circuit of FIG. 1.
Figure 4:
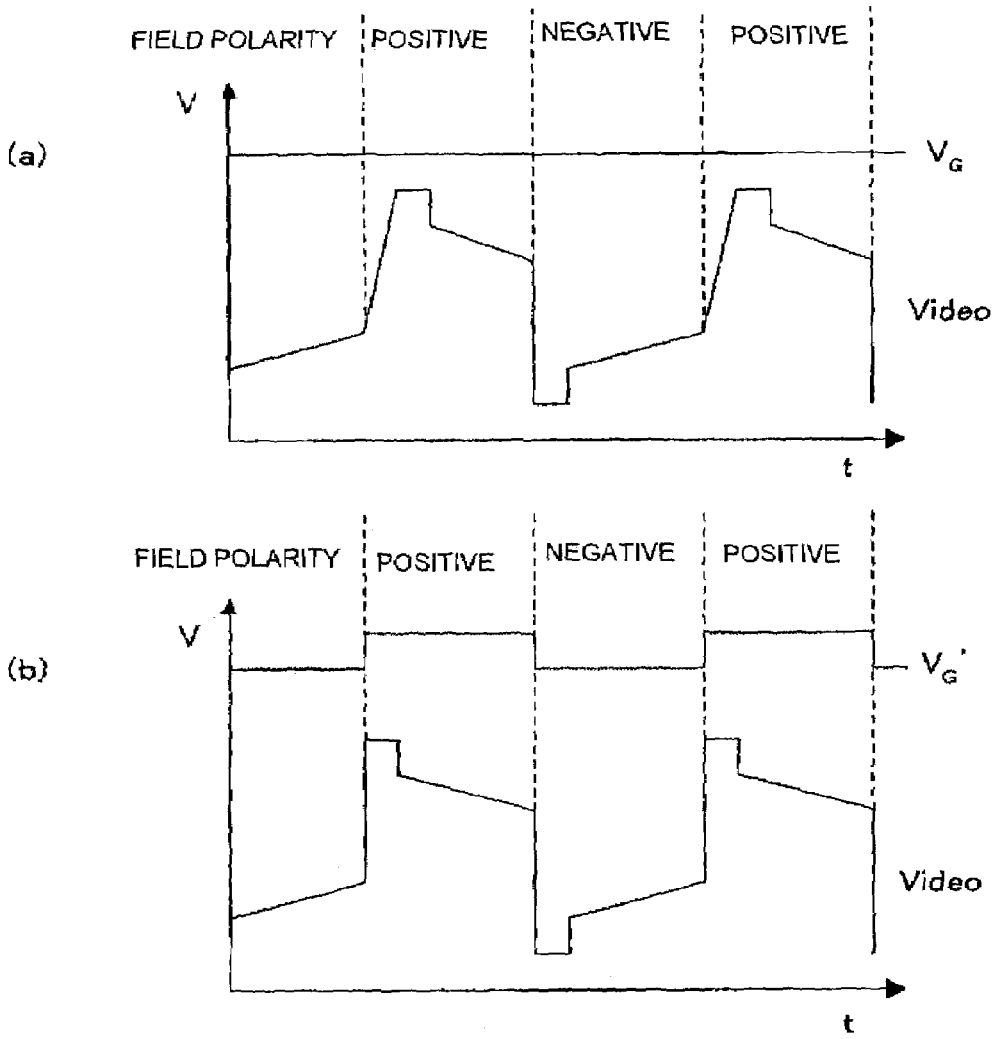
FIGS. 4(*a*) and 4(*b*) are timing charts showing a voltage which is written into a data line, in a comparative example in which the gate voltage of the first conductivity type TFT is fixed, as well as a timing chart showing a voltage which is written into a data line, in this exemplary embodiment in which the gate voltage of the first conductivity type TFT is changed.
Figure 5:
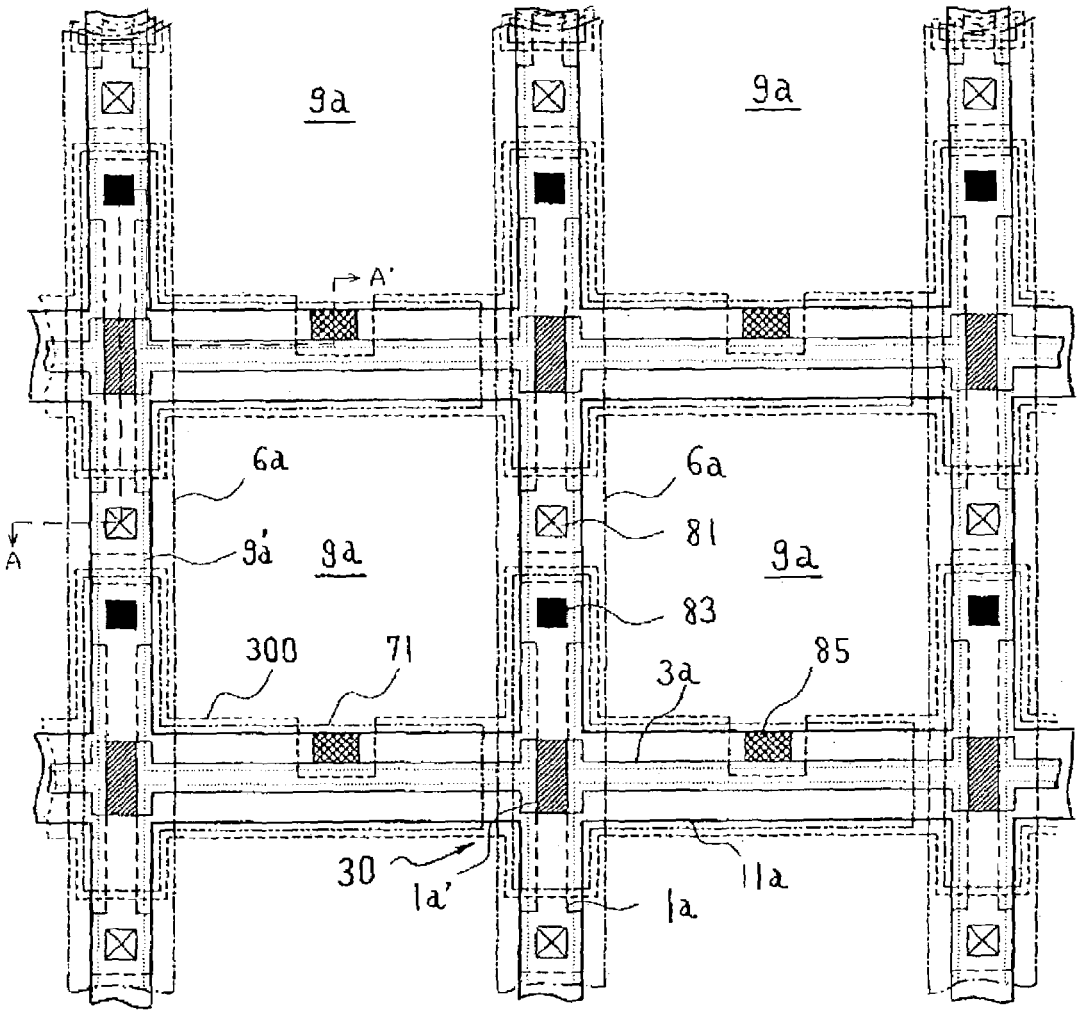
FIG. 5 is a plan view of a plurality of pixel groups adjacent to each other, on a TFT array substrate which is formed with data lines, scanning lines, pixel electrodes, etc. in the electrooptic device of the exemplary embodiment.

The first exemplary embodiment concerning the electrooptic device of the present invention is described with reference to FIGS. 1 through 6. FIG. 1 is a circuit diagram in which an equivalent circuit of various elements, wiring lines, etc., in a plurality of pixels formed in a matrix shape and constituting an image display region in the electrooptic device are shown together with the peripheral driver circuits thereof, FIGS. 2(*a*) and 2(*b*) are circuit diagrams showing an inverter included in the circuit, and FIG. 3 is a graph showing the writability characteristic of a TFT of first conductivity type included in the circuit. FIG. 4(*a*) is a timing chart showing a voltage which is written into a data line, in a comparative example in which the gate voltage of the first conductivity type TFT is fixed, while FIG. 4(*b*) is a timing chart showing a voltage which is written into a data line, in this exemplary embodiment in which the gate voltage of the first conductivity type TFT is changed. FIG. 5 is a plan view of a plurality of pixel groups adjacent to each other, on a TFT array substrate which is formed with data lines, scanning lines, pixel electrodes, etc.

Figure 6:
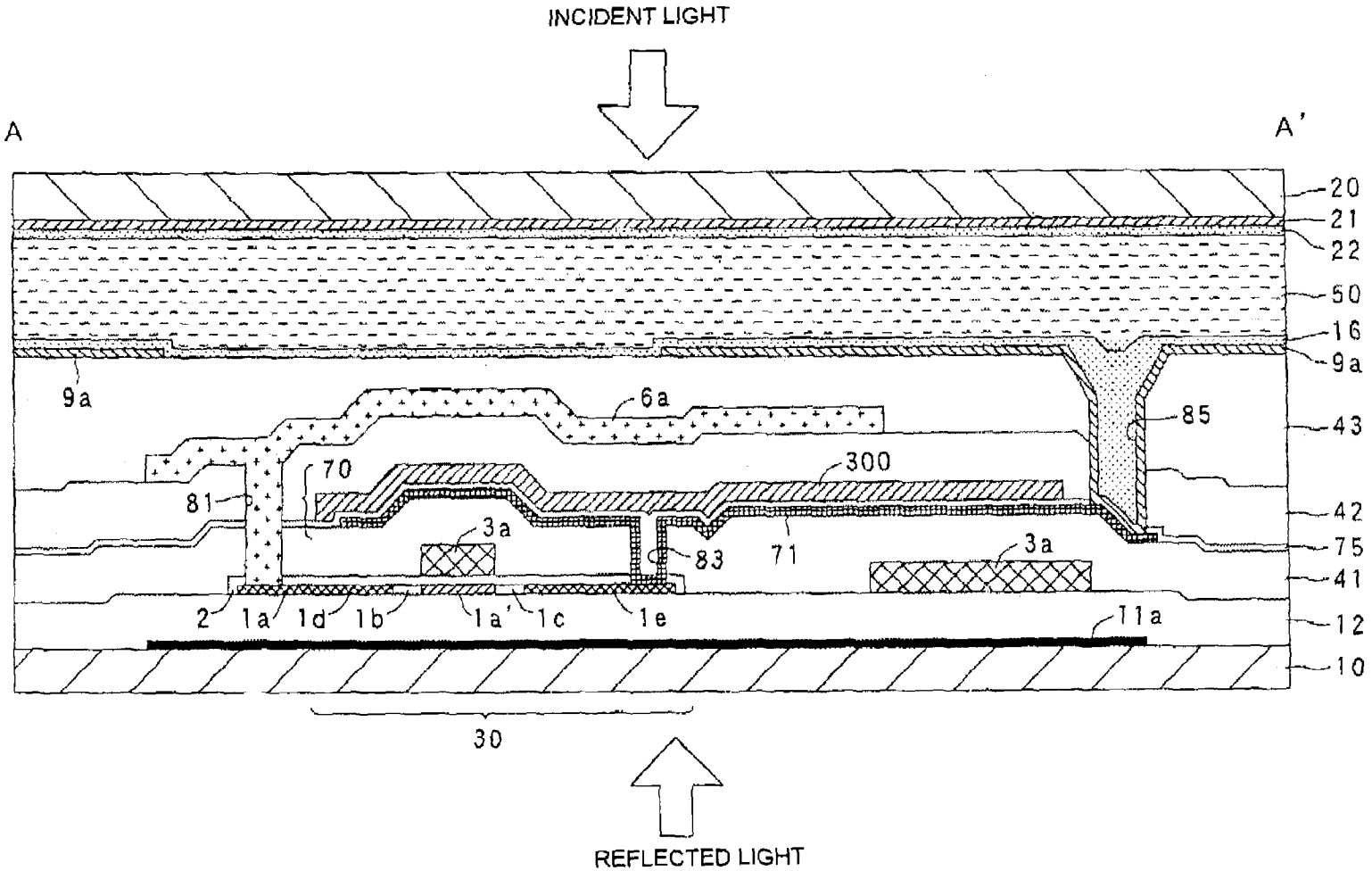
FIG. 6 is a sectional view taken along plane A–A' in FIG. 2.

FIG. 6 is a sectional view taken along plane A–A' in FIG. 5. In FIG. 6, individual layers and individual members have respectively different reduced scales for the purpose of making them large enough to be recognized in the drawing.

Referring to FIG. 1, each of a plurality of pixels, which constitute the image display region of the electrooptic device in this exemplary embodiment and which are formed in the shape of a matrix, is formed with a pixel electrode 9*a*, and a TFT 30 for the switching control of the pixel electrode 9*a*. Each data line 6*a* which is fed with an image signal, is electrically connected to the sources of the corresponding TFTs 30. Each scanning line 3*a* which is fed with a scanning signal, is electrically connected to the gates of the corresponding TFTs 30. The pixel electrode 9*a* and a storage capacitor 70 are electrically connected to the drain of the corresponding TFT 30.

The electrooptic device is constructed including a data line driver circuit 101, a scanning line driver circuit 104 and a sampling circuit 301 in a peripheral region which is located around the image display region.

The data line driver circuit 101 is constructed so as to sequentially feed sampling circuit drive signals to the sampling circuit 301 via sampling circuit drive signal lines 114.

The sampling circuit 301 includes a plurality of TFTs of first conductivity type 302 to sample use, that is, as sampling switches. Each first conductivity type TFT 302 has its source connected to a lead-out line 116 from an image signal line 115, has its drain connected to the data line 6*a*, and has its gate connected to the sampling circuit drive signal line 114. The sampling circuit 301 is constructed so as to sample image signals on the image signal line 115 and sequentially write the sampled signals into the corresponding data lines 6*a* as image signals S1, S2, . . . , and Sn, at the timings of the sampling circuit drive signals which are fed from the data linear driver circuit 101.

On the other hand, the scanning line driver circuit 104 is constructed so as to feed scanning signals G1, G2, . . . , and Gm to the corresponding scanning lines 3*a* pulse-wise at predetermined timings and in line sequence in this order.

In the image display region, the scanning signals G1, G2, . . . , and Gm are respectively applied from the scanning line driver circuit 104 to the gates of the TFTs 30 via the scanning lines 3*a* in line sequence. The image signals S1, S2, . . . , and Sn fed from the data lines 6*a* are respectively written into the pixel electrodes 9*a* at predetermined timings in such a way that each corresponding TFT 30 which is a pixel switching element is turned on for a predetermined time period. The image signals S1, S2, . . . , and Sn of predetermined levels written via the pixel electrodes 9*a* into a liquid crystal acting as an example of an electrooptic substance, are respectively retained between the pixel electrodes 9*a* and a common electrode formed in an counter substrate described below, for a predetermined time period. The liquid crystal modulates light and permits a gradational display in such a way that the orientation and order of its molecular aggregate are changed by the applied voltage levels. In a normally-white mode, the transmission factor of the liquid crystal for incident light decreases in response to a voltage applied in each individual pixel unit, and in a normally-black mode, the transmission factor for incident light increases in response to a voltage applied in each individual pixel unit, whereby light which has a contrast conforming to the image signals exits from the electrooptic device as a whole. In order to prevent the retained image signal from leaking or to reduce such leakage, the storage capacitor 70 is added in parallel with a liquid crystal capacitance which is formed between the pixel electrode 9*a* and the common electrode. As described in detail below, the storage capacitor 70 includes a pixel potential side capacitance electrode which is connected to the pixel electrode 9*a*, and a fixed potential side capacitance electrode which is arranged in opposition to the pixel potential side capacitance electrode with a dielectric film interposed therebetween. Capacitance lines 300 of fixed potential arrayed in juxtaposition with the scanning lines 3*a* are partially used as such fixed potential side capacitance electrodes.

In this exemplary embodiment, there is implemented 1H inversion drive in which the pixel electrodes 9*a* of the same rows are driven by a potential of identical polarity, and in which such a potential polarity is inverted in field cycles for every row. That is, the image signals fed onto the image signal line 115 are signals which involve the polarity inversion in field units. Thus, the deterioration of the liquid crystal attributed to DC voltage application can be effectively avoided or reduced.

The electrooptic device of this exemplary embodiment is especially furnished with a voltage selector/generator circuit 401. The voltage selector/generator circuit 401 may be formed in the peripheral region likewise to the data line driver circuit 101, etc., or it may be mounted as an externally-mounted IC of COG (Chip On Glass) type or the like or connected via suitable wiring lines laid from external circuit connection terminals. This voltage selector/generator circuit 401 is so constructed that voltages of two differing levels can be alternately changed-over in field cycles and fed to a supply voltage wiring line 402 as a supply voltage VCL. The data line driver circuit 101 includes inverters 502 to which outputs from a shift register 501 are respectively inputted and which are operated by the supply voltage VCL via the supply voltage wiring line 402, and it is constructed so as to deliver the outputs of the inverters 502 as the sampling circuit drive signals stated above.

Figure 2:
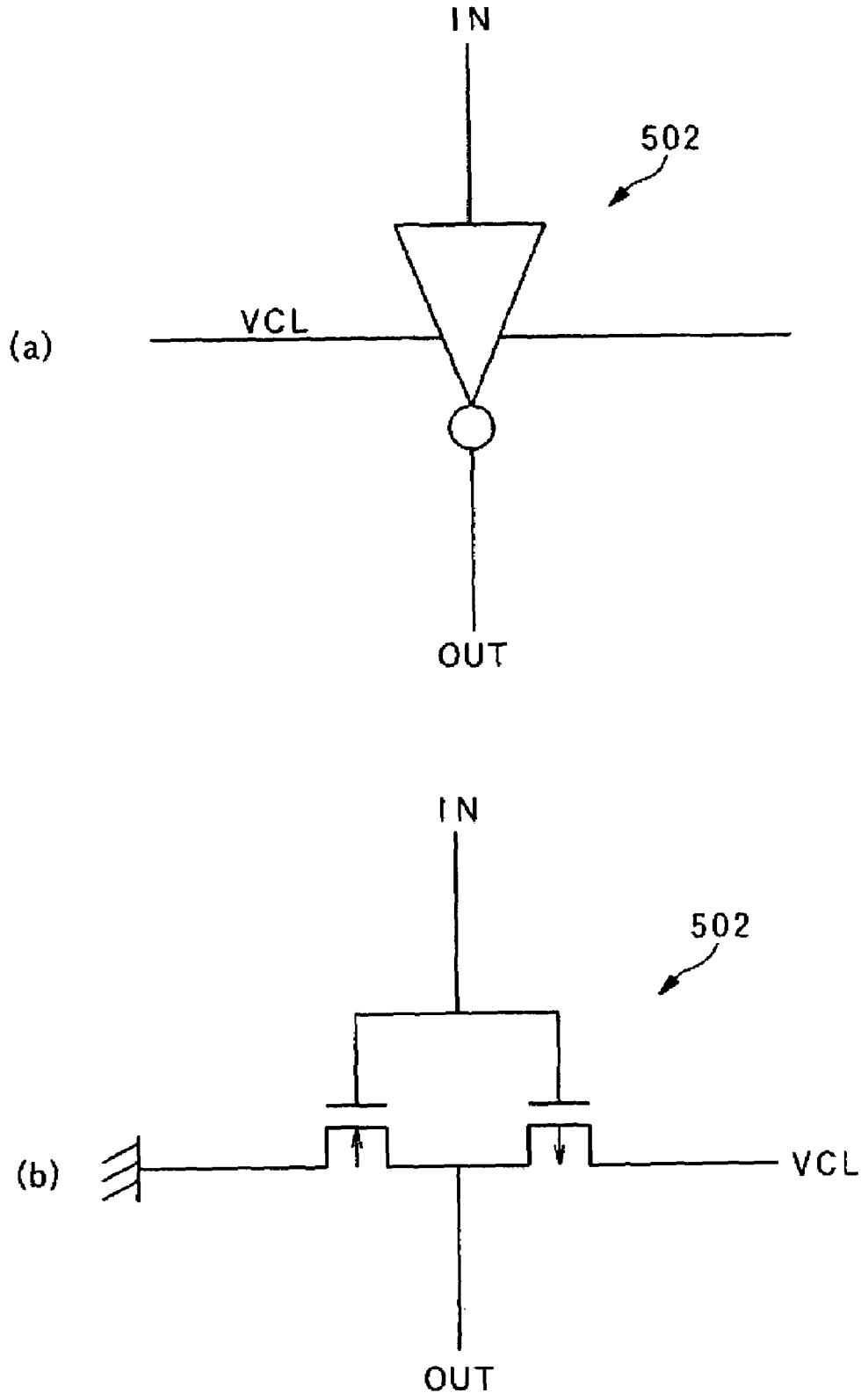
FIGS. 2(*a*) and 2(*b*) are circuit diagrams showing an inverter included in the circuit of FIG. 1.

More specifically, the inverter 502 indicated in FIG. 2(*a*) by the same reference numeral as in FIG. 1 has a circuit arrangement shown in FIG. 2(*b*) by way of example. This inverter is so constructed that, even when its input voltage IN (namely, the voltage of the output signal of the shift register 501 in FIG. 1) is constant, its output voltage OUT (namely, the voltage of the sampling circuit drive signal in FIG. 1) undergoes a two-valued change in response to the two-valued change of the supply voltage VCL.

The sampling circuit 301 is constructed of the first conductivity type transistors 302 as the sampling switches. Therefore, assuming that the gate voltage of each first conductivity type transistor 302 is held constant, the writability of this transistor, namely, the easiness of flow of the source/drain current of this transistor becomes different from each other for both the image signal of positive field and the image signal of negative field.

More specifically, in case of the first conductivity type TFT 302 which has the characteristic of the source/drain current I[A] versus the gate–source voltage $V_{GS}$[V] of this transistor as shown in FIG. 3 by way of example, the easiness of flow of the source/drain current or the writability of the first conductivity type TFT 302 exhibits a difference (Δ) between the positive field of the image signal and the negative field thereof. When the gate voltage $V_G$ is held constant in both the positive field and the negative field as shown as a comparative example in FIG. 4(*a*), image signal voltages Video which are written via the first conductivity type TFT 302 become asymmetric between in the positive field and in the negative field. As a result, a transmission factor in the electrooptic device gives rise to a difference between the positive field and the negative field, so that the flickering of a field frequency appears.

In contrast, according to this exemplary embodiment, the gate voltage $V_G'$ is changed to the amount of a predetermined voltage between the positive field and the negative field as shown in FIG. 4(*b*), whereby image signal voltages Video which are written via the first conductivity type TFT 302 become symmetric between in the positive field and in the negative field. The amount of the predetermined voltage to which the gate voltage $V_G'$ is changed between the positive field and the negative field can be evaluated in advance experimentally, empirically or theoretically or by simulation as a voltage component in the case where the image signals Video which become symmetric in both the positive field and the negative field are obtained. The two values of the supply voltage VCL thus obtained are set in the supply voltage selector/generator circuit 401 in advance. In the subsequent operation, such two values of the supply voltage VCL are alternately selected and generated in field cycles. In this way, it is permitted to sample the image signals so that the writability of the first conductivity type TFT 302 may exhibit almost no difference, or almost no difference in practical use between in the positive and negative fields.

As described above, as compared with the comparative example shown in FIG. 4(*a*), this exemplary embodiment shown in FIG. 4(*b*) can further reduce flickering in spite of the execution of the sampling by the first conductivity type TFTs 302. Moreover, the individual sampling switches of such a sampling circuit 301 are constructed of the first conductivity type TFTs 302, so that their layout in plan is easier than in case of sampling switches of, for example, CMOS type even when the pitch of the data lines 6*a* is narrowed.

As shown in FIG. 5, the plurality of transparent pixel electrodes 9*a* (whose contours are indicated by dotted line 9*a*') are disposed in the matrix shape on the TFT array substrate of the electrooptic device, and the data lines 6*a* and the scanning lines 3*a* are respectively laid along the vertical and lateral boundaries of the pixel electrodes 9*a*.

Each scanning line 3*a* is arranged so as to oppose to the channel regions 1*a*' of semiconductor layers 1*a* which are indicated by regions of rightward rising hatches in FIG. 5, and it includes the gate electrodes. Those gate electrode portions of the scanning line 3*a* which oppose to the channel regions 1*a*' are formed to be broader.

In this manner, the pixel switching TFTs 30, in which the broader parts of each scanning line 3*a* are arranged as the gate electrodes in opposition to the channel regions 1*a*', are disposed respectively at the intersection portions between the scanning line 3*a* and the main line portions 61*a* of the data lines 6*a*.

Each storage capacitor 70 is formed in such a way that a relay layer 71 which is the pixel potential side capacitance electrode connected to the heavily-doped drain region 1*e* of the TFT 30 and the pixel electrode 9*a*, and part of the capacitance line 300 serving as the fixed potential side capacitance electrode are arranged in opposition to each other separated by a dielectric film 75.

Each capacitance line 300 is constructed of, for example, a conductive light shield film containing a metal or an alloy, and it forms an example of an upper light shield film (built-in light shield film) and also functions as the fixed potential side capacitance electrode. The capacitance line 300 is formed of, for example, a metal element, an alloy, a metal silicide or a poly-silicide containing at least one of refractory metals such as Ti (titanium), Cr (chromium), W (tungsten), Ta (tantalum) and Mo (molybdenum), or a stacked layer made of such materials. This capacitance line 300 may well contain another metal such as Al (aluminum) or Ag (silver). Alternatively, it may also have a multilayer structure, in which a first film, formed of for example conductive polysilicon film, and a second film, formed of, for example, a metal silicide film containing a refractory metal, are stacked.

On the other hand, the relay layer 71 is formed of, for example, a conductive polysilicon film, and it functions as the pixel potential side capacitance electrode. In addition to the function of the pixel potential side capacitance electrode, the relay layer 71 has the function of a light absorption layer or another example of an upper light shield film as is arranged between the capacitance line 300 acting as the upper light shield film and the TFT 30. Further, it has the function of relay-connecting the pixel electrode 9*a* and the heavily-doped drain region 1*e* of the TFT 30. The relay layer 71, however, may be formed of a single-layer film or a multilayer film containing a metal or an alloy, similarly to the capacitance line 300.

When viewed in plan, each capacitance line 300 stretches in the shape of a stripe along the scanning line 3*a*, and its portion, which is overlapping the TFT 30, protrudes up and down in FIG. 5. The data lines 6*a* each extending in the vertical direction in FIG. 5, and the capacitance lines 300 each extending in the lateral direction in FIG. 5 are formed by intersecting with each other. Thus, when viewed in plan, the upper light shield films (built-in light shield films) in a checkered pattern are constructed on the upper sides of the TFTs 30 over the TFT array substrate 10, and the open regions of the each pixel is defined.

Lower light shield films 11*a* are disposed in a checkered pattern on the lower sides of the TFTs 30 over the TFT array substrate 10. Likewise to the capacitance line 300 forming the example of the upper light shield film as stated before, each lower light shield film 11*a* is formed of, for example, a metal element, an alloy, a metal silicide or a poly-silicide containing at least one of refractory metals, such as Ti, Cr, W, Ta and Mo, or a stacked layer made of such materials. Alternatively, the lower light shield film 11*a* is formed containing another metal, such as Al or Ag.

The dielectric film 75 which is interposed between the relay layer 71 acting as the capacitance electrode and the capacitance line 300, is formed of, for example, a silicon oxide film, such as HTO (High Temperature Oxide) film or LTO (Low Temperature Oxide) film, or a silicon nitride film, which is a comparatively thin film being about 5–200 nm (nanometers) thick. From the viewpoint of enlarging the capacitance of the storage capacitor 70, the dielectric film 75 is better as it is thinner, subject to a satisfactory reliability of this film.

Each capacitance line 300 is extended from the image display region where the pixel electrodes 9*a* are arranged, to the surroundings thereof, and it is connected with a constant potential source and is held at a fixed potential. Such a constant potential source may be the constant potential source of a positive supply voltage or negative supply voltage which is fed to the data line driver circuit 101 or scanning line driver circuit 104 shown in FIG. 1, or it may be a fixed potential which is fed to the common electrode 21 of the counter substrate 20. Further, each lower light shield film 11*a* may be extended from the image display region to the surroundings thereof and connected with a constant potential source likewise to the capacitance line 300, in order to reduce or prevent the potential fluctuation of this film 11*a* from affecting the TFT 30 adversely.

Each pixel electrode 9*a* is relayed by the relay layer 71, thereby to be electrically connected to the heavily-doped drain region 1*e* of the semiconductor layer 1*a* via contact holes 83 and 85. That is, in this exemplary embodiment, the relay layer 71 fulfills the function of relay-connecting the pixel electrode 9*a* to the TFT 30, in addition to the function as the pixel potential side capacitance electrode of the storage capacitor 70 and the function as the light absorption layer. Such utilization of the relay layer 71 permits a pixel aperture efficiency to be heightened, for the reason that, even when the inter-layer distance between the layers of the pixel electrode 9*a* and the heavily-doped drain region 1*e* is as long as about 2000 nm by way of example, both the layers can be favorably connected via the contact holes or grooves while avoiding the technical difficulty of connecting both the layers via a single contact hole. The relay layer 71 also serves to prevent etching from punching through at the steps of providing the contact holes.

As shown in FIG. 6, the electrooptic device includes the transparent TFT array substrate 10, and the transparent counter substrate 20 which is arranged in opposition to the substrate 10. The TFT array substrate 10 is made of, for example, a quartz substrate, a glass substrate or a silicon substrate, while the counter substrate 20 is made of, for example, a glass substrate or a quartz substrate.

The TFT array substrate 10 is provided with each pixel electrode 9*a*, which is overlaid with an orientation film 16 subjected to a predetermined orientation treatment such as rubbing. The pixel electrode 9*a* is made of a transparent conductive film, for example, ITO (Indium Tin Oxide) film. The orientation film 16 is made of an organic film, for example, polyimide film.

On the other hand, the counter substrate 20 is provided with the common electrode 21 over the whole area thereof, and the common electrode 21 is underlaid with an orientation film 22 subjected to a predetermined orientation treatment, such as rubbing. The common electrode 21 is made of a transparent conductive film, for example, ITO film. The orientation film 22 is made of an organic film, such as polyimide film.

The counter substrate 20 may be provided with light shield films of checkered pattern or striped shape. When such a construction is adopted, incident light from the side of the counter substrate 20 can be more reliably prevented from entering the channel region 1*a*' and a lightly-doped source region 1*b* as well as a lightly-doped drain region 1*c*, by each light shield film over the counter substrate 20 together with the capacitance line 300 and the data line 6*a* which forms the upper light shield films as stated before.

A liquid crystal which is an example of the electrooptic substance is enclosed between the TFT array substrate 10 and the counter substrate 20 which are thus constructed and which are arranged with the pixel electrodes 9*a* and the common electrode 21 facing to each other, and in a space surrounded with a sealant explained below, whereby a liquid crystal layer 50 is formed. The liquid crystal layer 50 is brought into a predetermined oriented state by the orientation films 16 and 22 in a state where an electric field from each pixel electrode 9*a* is not applied. This liquid crystal layer 50 is made of a liquid crystal in which one kind or several kinds of nematic liquid crystals are mixed by way of example. The sealant is a binder which is made of, for example, a photosetting resin or a thermosetting resin to stick the TFT array substrate 10 and the counter substrate 20 together at the peripheral portions thereof, and in which a gap material, such as glass fiber or glass beads to set the distance between the both substrates at a predetermined value, is mixed.

Further, a subbing insulating film 12 is provided under the pixel switching TFTs 30. The subbing insulating film 12 has the function of insulating each TFT 30 from the lower light shield film 11*a* for the inter-layer insulation. Since the subbing insulating film 12 is formed over the whole area of the TFT array substrate 10, it has the function of reducing or preventing the characteristics of the pixel switching TFTs 30 from deteriorating due to the roughness of the TFT array substrate 10 in the surface polishing thereof, the dirt of the TFT array substrate 10 remaining after the wash thereof, etc.

Referring to FIG. 6, each pixel switching TFT 30 has an LDD (Lightly Doped Drain) structure. It is constituted by the scanning line 3*a*, the channel region 1*a*' of the semiconductor layer 1*a* in which a channel is formed by an electric field from the scanning line 3*a*, an insulating film 2 which insulates the scanning line 3*a* and the semiconductor layer 1*a* and which includes a gate insulating film, the lightly-doped source region 1*b* as well as the lightly-doped drain region 1*c* of the semiconductor layer 1*a*, and the heavily-doped source region 1*d* as well as the heavily-doped drain region 1*e* of the semiconductor layer 1*a*.

Formed on the scanning line 3*a* is a first inter-layer insulating film 41 in which a contact hole 81 leading to the heavily-doped source region id, and the contact hole 83 leading to the heavily-doped drain region 1*e* are respectively provided.

The first inter-layer insulating film 41 is overlaid with the relay layer 71 and the capacitance line 300, which are overlaid with a second inter-layer insulating film 42 where the contact holes 81 and 85 are respectively provided.

The data line 6*a* is formed on the second inter-layer insulating film 42, and they are overlaid with a third inter-layer insulating film 43 which is formed with the contact hole 85 leading to the relay layer 71. The pixel electrodes 9*a* are provided on the upper surface of the third inter-layer insulating film 43 thus constructed.

As described above with reference to FIGS. 1 through 6, according to the first exemplary embodiment, an example of a gate voltage varying unit is constituted by the voltage selector/generator circuit 401 and the inverters 502. Accordingly, the 1H inversion drive can be favorably implemented while a definition is heightened, and an image display of high quality with reduced flickering becomes possible.

By the way, in the foregoing exemplary embodiment, each TFT 30 for pixel switching is of top-gate type, but it may be a TFT of bottom-gate type. In addition, the TFT 30 may be constructed including a single-crystal semiconductor layer based on a stuck SOI structure. Although the switching TFT 30 should preferably have the LDD structure as shown in FIG. 6, it may have an offset structure in which impurity ions are not implanted into each of the lightly-doped source region 1*b* and the lightly-doped drain region 1*c*, or it may be a TFT of self-alignment type in which impurity ions are implanted at a high concentration by employing the gate electrodes, formed of parts of the scanning lines 3*a*, as a mask, thereby to form heavily-doped source and drain regions in self-alignment fashion. Further, in this exemplary embodiment, the pixel switching TFT 30 has a single-gate structure in which only one gate electrode is arranged between the heavily-doped source region 1*d* and the heavily-doped drain region 1*e*, but two or more gate electrodes may be arranged between them. Still further, the present invention is not restricted to a liquid crystal device of projection type or transmission type. When the present invention is applied to a liquid crystal device of reflection type, the effect of reducing the flickering according to this exemplary embodiment is similarly attained.

Moreover, in the 1H inversion drive scheme in this exemplary embodiment, the polarity of the drive voltage may be inverted for every row, or it may be inverted for every two rows adjacent to each other and etc.

(Second Exemplary Embodiment)

Figure 7:
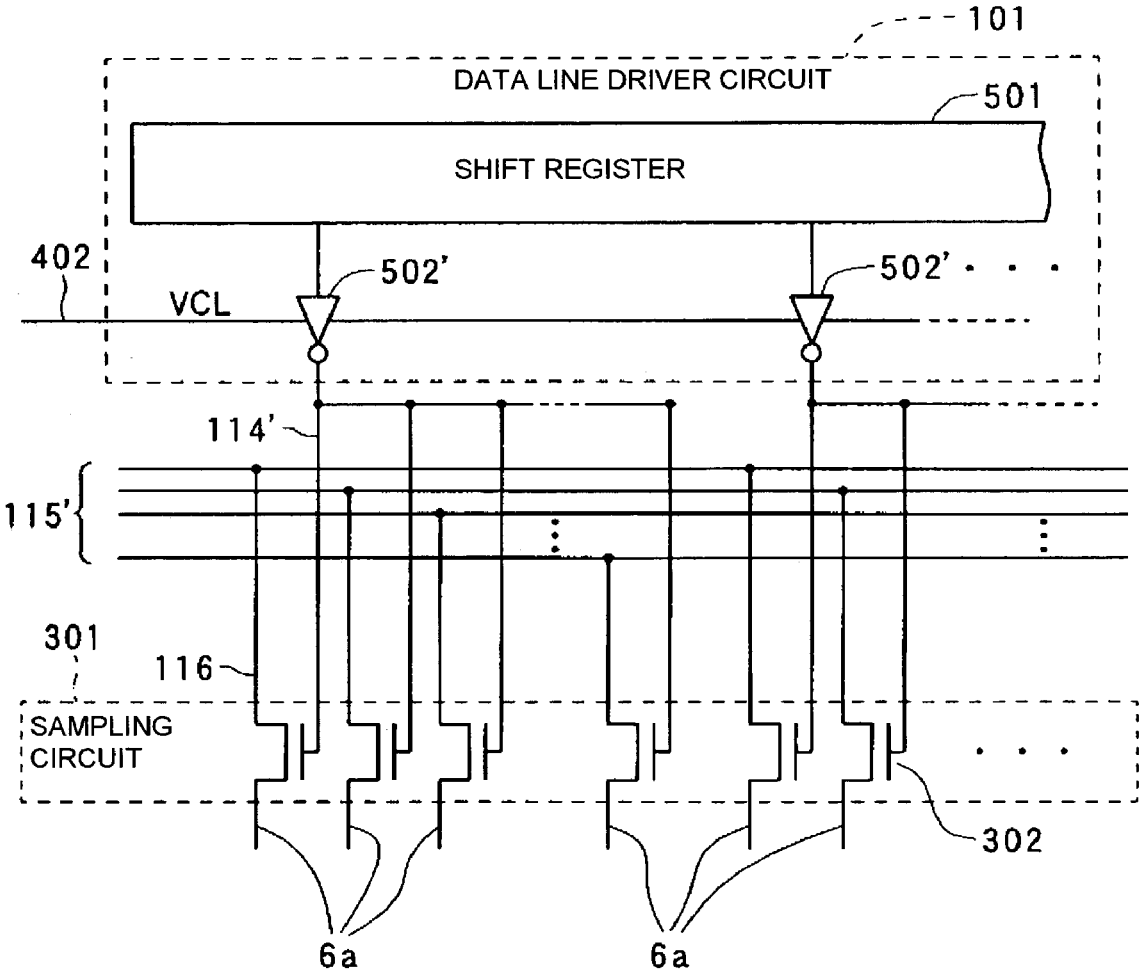
FIG. 7 is an enlarged schematic showing on an enlarged scale, portions which concern a data line driver circuit and a sampling circuit in a second exemplary embodiment.

Next, the second exemplary embodiment of the electrooptic device of the present invention is described with reference to FIG. 7. FIG. 7 is an enlarged schematic showing on an enlarged scale, portions which concern a data line driver circuit and a sampling circuit in the second exemplary embodiment.

When compared with the first exemplary embodiment described above, the second exemplary embodiment differs in constructions and operations concerning the data line driver circuit and the image signal line, and it is similar in the other constructions and operations. Therefore, the constructions and operations different from those of the first exemplary embodiment are described below.

As shown in FIG. 7, in the second exemplary embodiment, image signal lines 115' are laid in a number m (where m denotes a natural number of at least 2), and they are fed with image signals obtained by serial-to-parallel conversion. Each (m) TFTs of first conductivity type 302 connected to the (m) image signal lines 115' are fed with the output of one inverter 502' through corresponding ones of branched sampling circuit drive signal lines 114', so as to simultaneously drive the (m) first-conductivity-type TFTs 502. That is, the second exemplary embodiment is constructed so as to simultaneously drive (m) data lines 6*a* adjacent to one another.

Any one of for example, 6, 12, 24, . . . is adopted as the number (m) for the simultaneous drive. When the number for the simultaneous drive is increased, a drive frequency can be lowered.

In this manner, according to the second exemplary embodiment, the number of the inverters 502 is decreased to 1/m as compared with the number of the data lines 6*a*. Accordingly, as the first conductivity type TFTs 302 each having a comparatively simple construction are fabricated at a minute pixel pitch, the inverters 502 each having a comparatively complicated construction (refer to FIG. 2(*b*)) may be fabricated with a pitch which is as low as 1/m of a pixel pitch. Therefore, the plan layout of the elements becomes still easier than in the first exemplary embodiment.

(Third Exemplary Embodiment)

Figure 8:
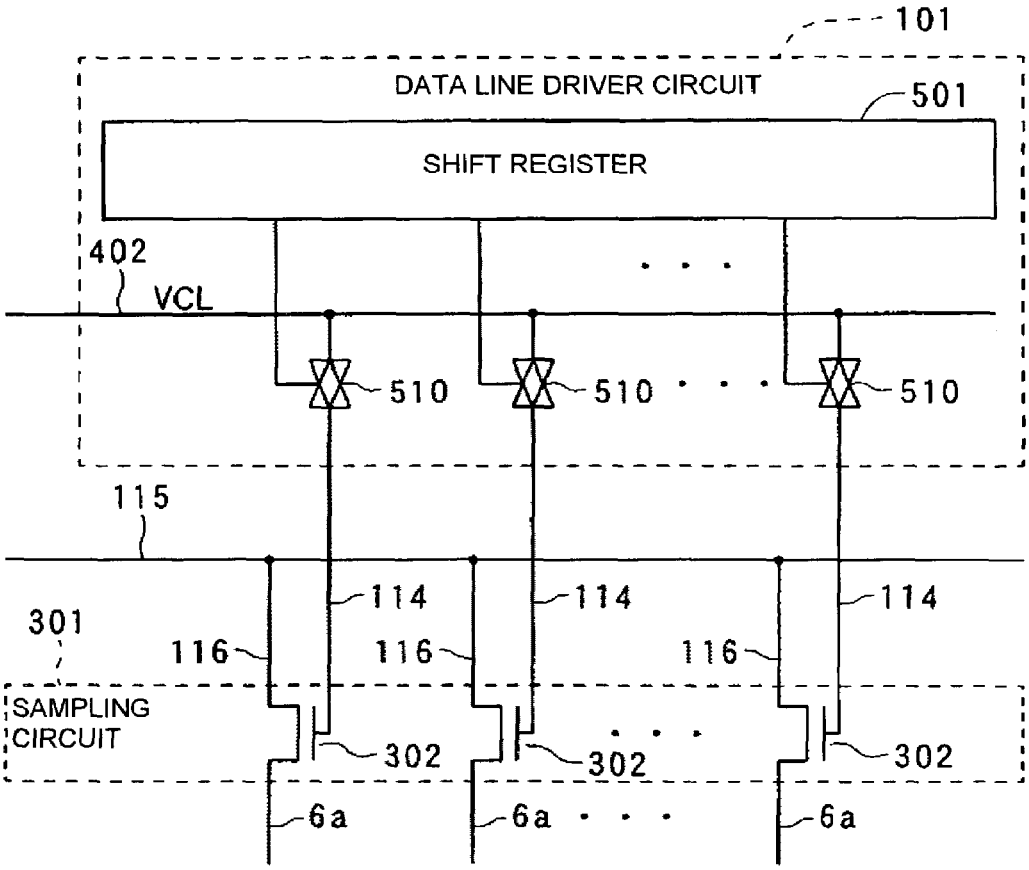
FIG. 8 is an enlarged schematic showing on an enlarged scale, portions which concern a data line driver circuit and a sampling circuit in a third exemplary embodiment.
Figure 9:
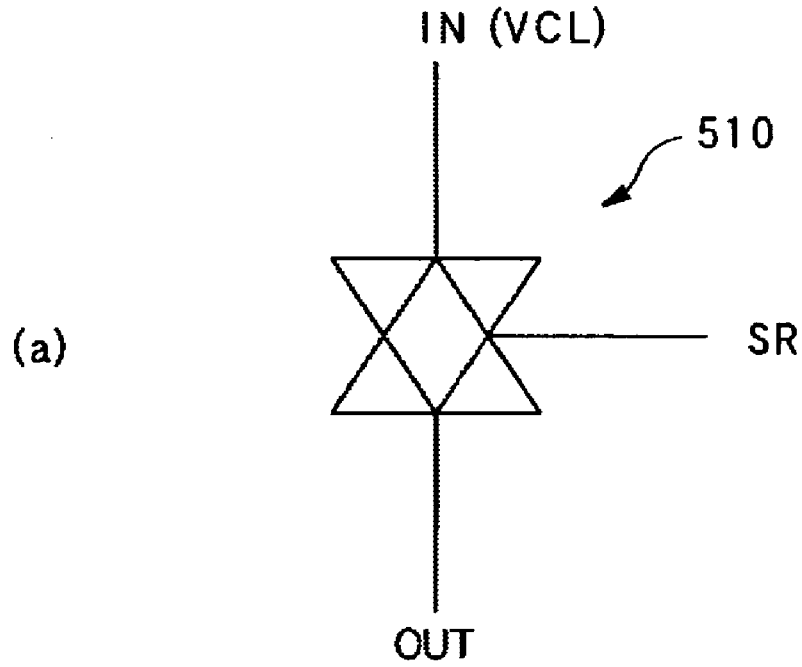
FIGS. 9(*a*) and 9(*b*) are circuit diagrams showing a transmission gate in the circuitry in FIG. 8.
Figure 9:
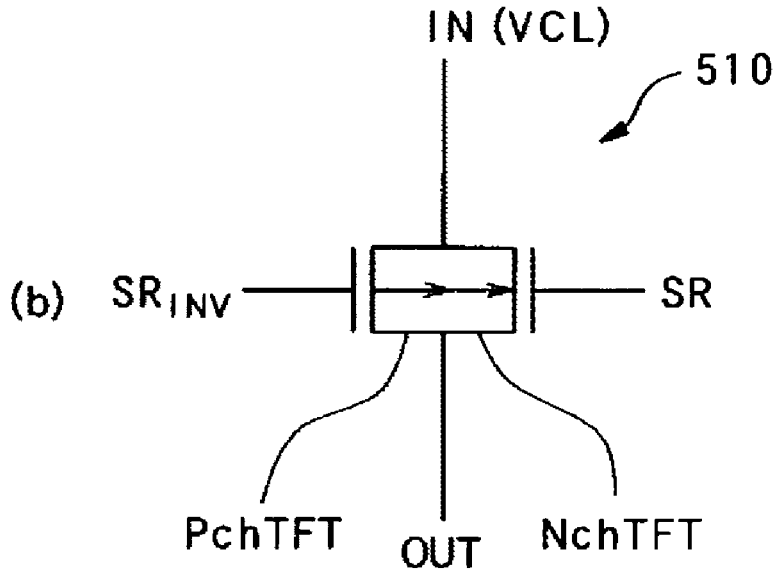

Next, the third exemplary embodiment of the electrooptic device of the present invention is described with reference to FIGS. 8 and 9(*a*)–9(*b*). FIG. 8 is an enlarged schematic showing on an enlarged scale, portions which concern a data line driver circuit and a sampling circuit in the third embodiment. FIGS. 9(*a*) and 9(*b*) are circuit diagrams showing a transmission gate in the circuitry in FIG. 8.

When compared with the first exemplary embodiment described above, the third exemplary embodiment differs in constructions and operations concerning the data line driver circuit and the image signal line, and it is similar in the other constructions and operations. Therefore, the constructions and operations different from those of the first embodiment are described below.

As shown in FIG. 8, in the third exemplary embodiment, the data line driver circuit 101 includes a plurality of transmission gates 510 instead of the inverters 502 compared with the first exemplary embodiment. The output terminals of the transmission gates 510 are respectively connected to the corresponding sampling circuit drive signal lines 114. The input terminals of the transmission gates 510 are all connected to the supply voltage wiring line 402 which is fed with the two-valued supply voltage VCL.

The output signals sequentially delivered from the shift register 501 are inputted to the control terminals of the respective transmission gates.

More specifically, the transmission gate 510 indicated in FIG. 9(*a*) by the same reference numeral as in FIG. 8 has a circuit arrangement shown in FIG. 9(*b*) by way of example. This transmission gate is so constructed that, even when the output voltage SR of the shift register 501 (and the inverted output voltage $SR_{INV}$ thereof) is (are) constant, the output voltage OUT of the transmission gate (namely, the voltage of the sampling circuit drive signal in FIG. 8) undergoes a two-valued change in response to the two-valued change of the input voltage IN thereof (namely, the supply voltage VCL in FIG. 8).

In this manner, according to the third exemplary embodiment, the gate voltage of each first conductivity type TFT 302 can be changed using the corresponding transmission gate 510, and it is possible to reduce the flickering in a displayed image.

(Fourth Exemplary Embodiment)

Figure 10:
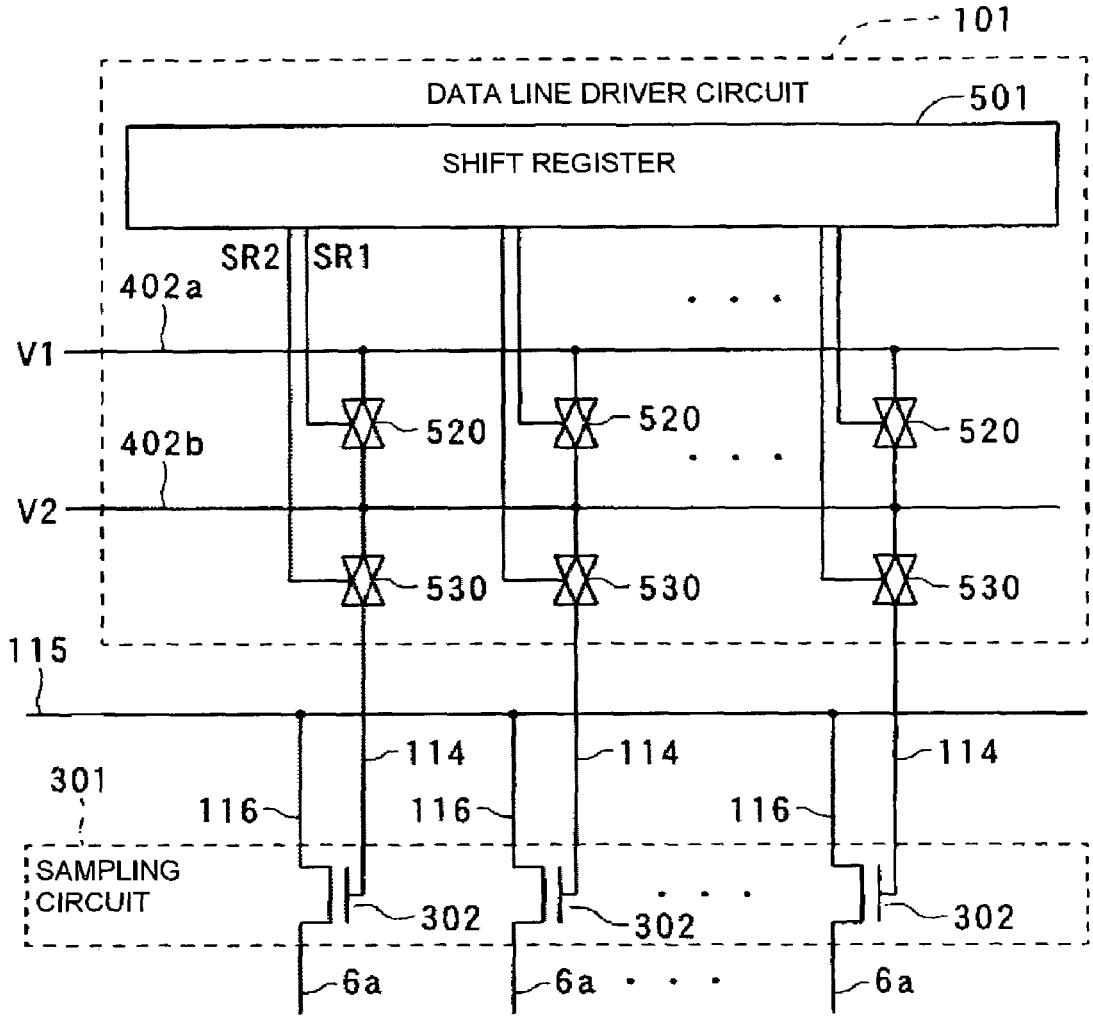
FIG. 10 is an enlarged schematic showing on an enlarged scale, portions which concern a data line driver circuit and a sampling circuit in a fourth exemplary embodiment.
Figure 11:
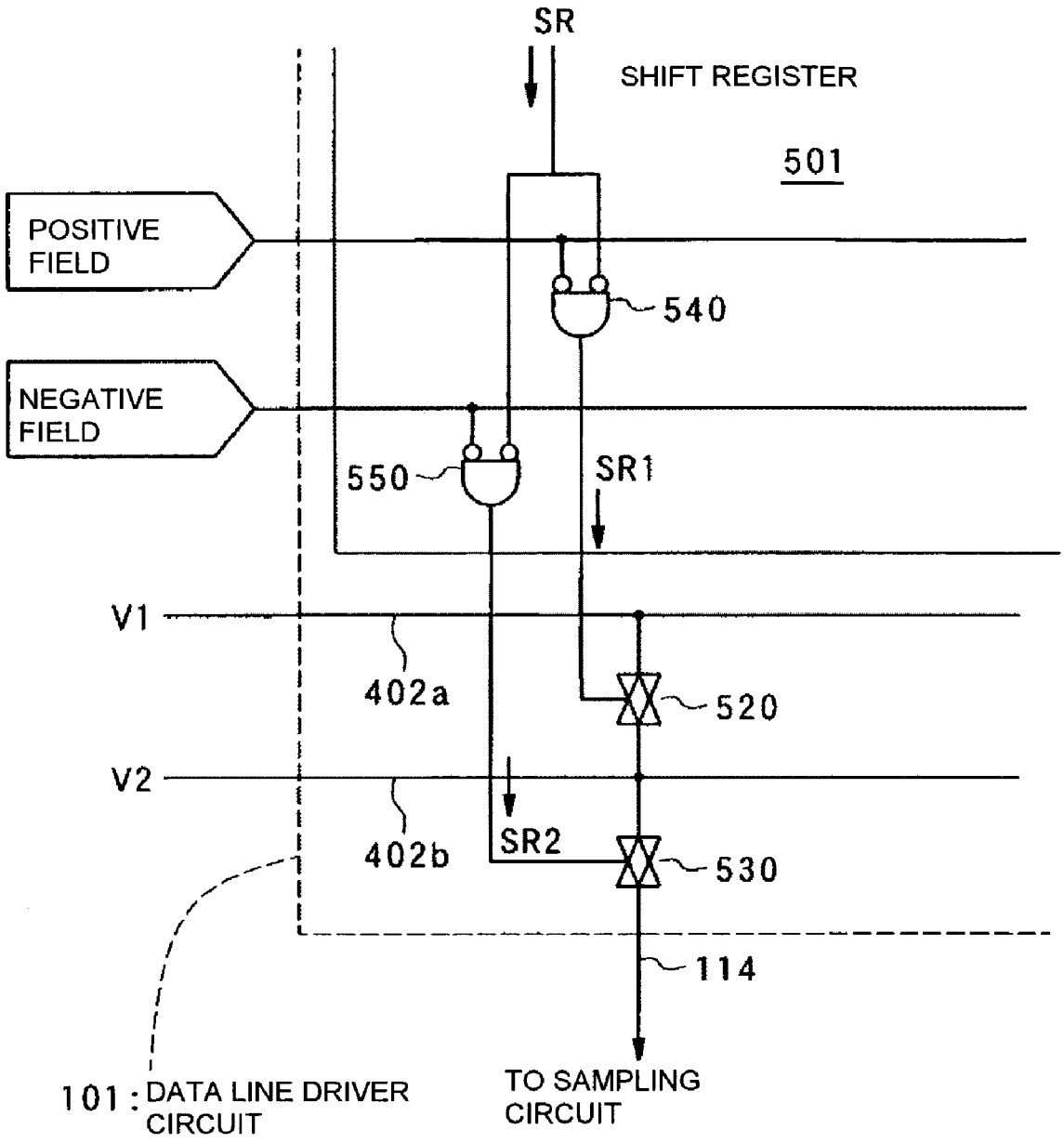
FIG. 11 is an enlarged circuit diagram of a circuit portion which is disposed within a shift register in the circuitry in FIG. 10, and which selectively outputs a shift signal in response to the polarity of a field.

The fourth exemplary embodiment of the electrooptic device of the present invention is described with reference to FIGS. 10 and 11. FIG. 10 is an enlarged schematic showing on an enlarged scale, portions which concern a data line driver circuit and a sampling circuit in the fourth exemplary embodiment. FIG. 11 is an enlarged circuit diagram of a circuit portion which is disposed within a shift register in the circuitry in FIG. 10, and which selectively outputs a shift signal in response to the polarity of a field.

When compared with the first exemplary embodiment described before, the fourth exemplary embodiment differs in constructions and operations concerning the data line driver circuit and the image signal line, and it is similar in the other constructions and operations. Therefore, the constructions and operations different from those of the first exemplary embodiment are described below.

As shown in FIG. 10, in the fourth exemplary embodiment, the data line driver circuit 101 includes a plurality of pairs of transmission gates 520 and 530 instead of the inverters 502 in the first exemplary embodiment. The output terminals of the transmission gates 530 are respectively connected to the corresponding sampling circuit drive signal lines 114. The input terminals of the transmission gates 520 are all connected to a supply voltage wiring line 402*a* which is fed with a first fixed potential V1, while the input terminals of the transmission gates 530 are all connected to a supply voltage wiring line 402*b* which is fed with a second fixed potential V2. Output signals SR1 sequentially delivered from the shift register 501 are inputted to the control terminals of the respective transmission gates 520, while output signals SR2 sequentially delivered from the shift register 501 are inputted to the control terminals of the respective transmission gates 530.

More specifically, as shown in FIG. 11, the data line driver circuit 101 includes NAND circuits 540 each of which is fed with the shift signal SR sequentially outputted from the shift register 501, and a positive field signal assuming, for example, a high level during a positive field period, and it further includes NAND circuits 550 each of which is fed with the shift signal SR sequentially outputted from the shift register 501, and a negative field signal assuming, for example, the high level during a negative field period. The output signal SR1 from the NAND circuit 540 is inputted to the control terminal of the corresponding transmission gate 520, while the output signal SR2 from the NAND circuit 550 is inputted to the control terminal of the corresponding transmission gate 530. As a result, the first fixed potential V1 and the second fixed potential V2 are alternately outputted as the sampling circuit drive signals in response to the positive and negative polarities concerning the respective fields of the image signals.

In this manner, according to the fourth exemplary embodiment, the gate voltage of each first conductivity type TFT 302 can be changed using the corresponding transmission gates 520 and 530, and it is possible to reduce the flickering in a displayed image.

Especially, when compared with each of the first to third exemplary embodiments, the fourth exemplary embodiment need not employ the supply voltage VCL acting as a clock signal of high voltage, so that it can attain curtailment in cost. Moreover, the fourth exemplary embodiment may be so constructed that one of the fixed potentials V1 and V2 is shared with a supply voltage for the data line driver circuit 101, while the other is fed via an external circuit connection terminal and a supply voltage wiring line connected thereto. Thus, the number of dedicated supply voltages required for varying the gate voltages of the first conductivity type TFTs 302 can be made to be smaller.

The first conductivity type transistor in each of the exemplary embodiments constructed as thus far described may be either an N-channel type transistor or a P-channel type transistor.

In case of the N-channel type transistor, the source/drain current is easier to flow for the negative polarity. It is therefore possible to lower the writability on the occasion of the negative polarity by making the gate voltage relatively small, and to heighten the writability on the occasion of the positive polarity by making the gate voltage relatively large.

On the other hand, in case of the P-channel type transistor, the source/drain current is easier to flow for the positive polarity. It is therefore possible to lower the writability on the occasion of the positive polarity by making the gate voltage relatively small, and to heighten the writability on the occasion of the negative polarity by making the gate voltage relatively large.

(Whole Construction of Electrooptic Device)

Figure 12:
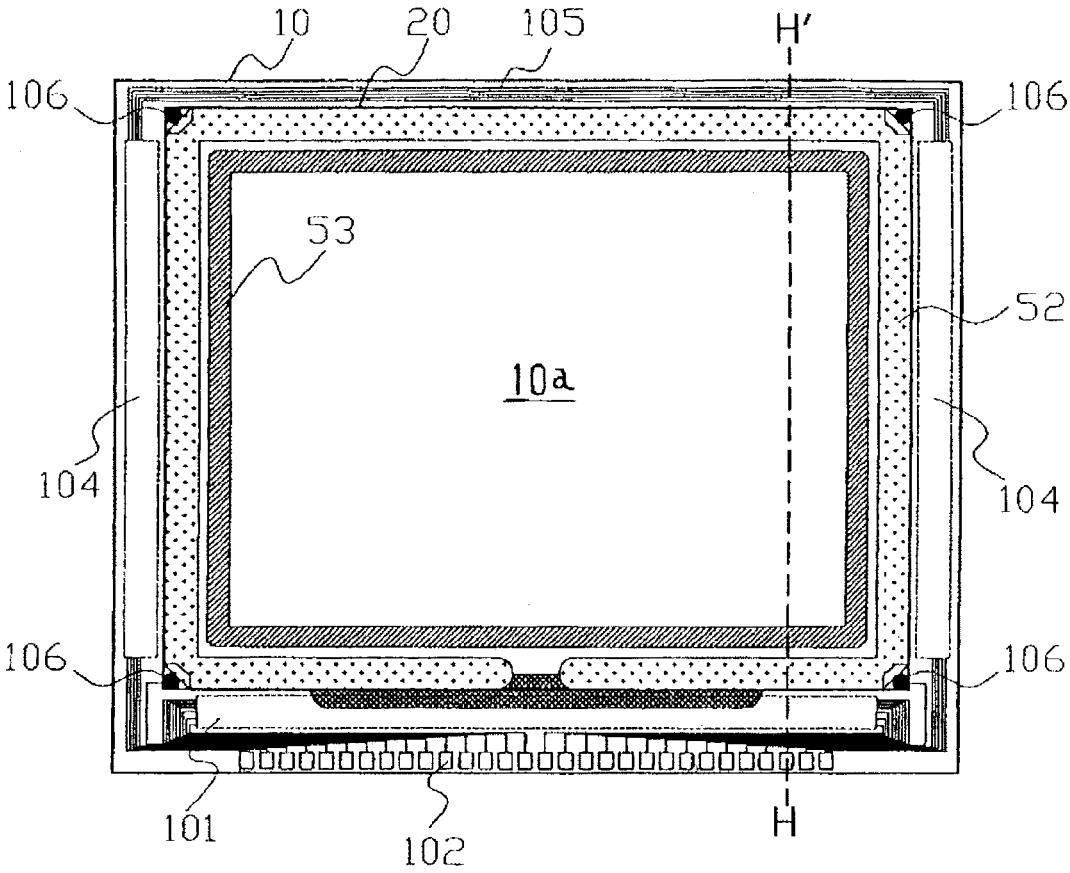
FIG. 12 is a plan view in which the TFT array substrate in the electrooptic device of each exemplary embodiment is seen from the side of an counter substrate, together with the various constituents formed thereon.
Figure 13:
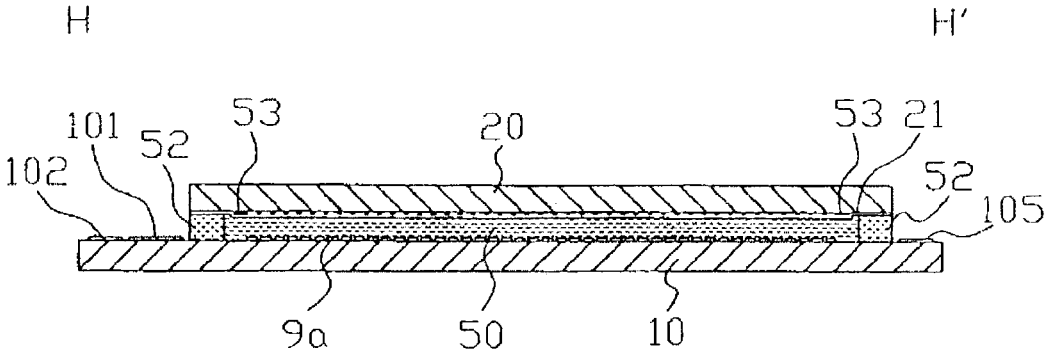
FIG. 13 is a sectional view taken along plane H–H' in FIG. 12.

The whole construction of the electrooptic device in each of the exemplary embodiments constructed as explained above is described with reference to FIGS. 12 and 13. FIG. 12 is a plan view in which the TFT array substrate 10 is seen from the side of the counter substrate 20, together with the various constituents formed thereon, while FIG. 13 is a sectional view taken along plane H–H' in FIG. 12.

Referring to FIG. 12, a sealant 52 is disposed on the TFT array substrate 10 so as to extend along the edges thereof, and a light shield film 53 which serves as a picture frame defining the perimeter of an image display region 10*a* is disposed inside the sealant 52 in parallel therewith. In a region outside the sealant 52, a data line driver circuit 101 and external circuit connection terminals 102 are disposed along one side of the TFT array substrate 10, while scanning line driver circuits 104 are disposed along two sides adjoining the above side. On condition that the delays of scanning signals to be fed to scanning lines 3*a* are not problematic, the scanning line driver circuit 104 may, of course, be disposed on only one side. Besides, such data line driver circuits 101 may be also arrayed on both sides along the sides of the image display region 10*a*. Further, a plurality of wiring lines 105 to join the scanning line driver circuits 104 disposed on both the sides of the image display region 10*a* are laid along one remaining side of the TFT array substrate 10. In addition, a conductive material 106 to establish electrical conduction between the TFT array substrate 10 and the counter substrate 20 is disposed at, at least, one of the corner parts of the counter substrate 20. As shown in FIG. 13, the counter substrate 20 which has substantially the same contour as that of the sealant 52 shown in FIG. 12 is secured to the TFT array substrate 10 by this sealant 52.

The TFT array substrate 10 may be also overlaid with, not only the data line driver circuit 101, scanning line driver circuits 104, etc., but also precharge circuits which feed precharge signals of predetermined voltage level to a plurality of data lines 6*a* before the feed of image signals, respectively, an inspection circuit which serves to inspect the quality, defects, etc. of the electrooptic device midway of manufacture or at shipment, and so forth.

In each of the exemplary embodiments described with reference to FIGS. 1 through 13 in the above, the data line driver circuit 101 and the scanning line driver circuit 104 are disposed on the TFT array substrate 10, but they may alternatively be electrically and mechanically connected to a driving LSI which is mounted on, for example, a TAB (Tape Automated Bonding) substrate, via an anisotropic conductive film which is disposed at the peripheral part of the TFT array substrate 10. A polarization film, a phase difference film, a polarizing plate, etc. are arranged in predetermined directions on the side of the counter substrate 20 from which projected light enters, and on the side of the TFT array substrate 10 from which exit light emerges, in response to, for example, operation modes, such as a TN (Twisted Nematic) mode, an STN (Super Twisted Nematic) mode, a VA (Vertically Aligned) mode and a PDLC (Polymer Dispersed Liquid Crystal) mode, and either of a normally white mode and a normally black mode.

The electrooptic device in each of the exemplary embodiments described above is applied to a projector. Therefore, three such electrooptic devices are respectively used as light valves for the three primary colors RGB, and light components of the respective colors decomposed through dichroic mirrors for RGB color decomposition are respectively entered into the light valves as projected light. In each exemplary embodiment, accordingly, the counter substrate 20 is not provided with color filters. The RGB color filters, however, may be also formed on the predetermined region of the counter substrate 20 opposing to the corresponding pixel electrodes 9*a*, together with protective films therefor. Thus, the electrooptic device in each exemplary embodiment can be applied to a color electrooptic apparatus of direct view type or reflection type, other than the projector. Each microlens may be formed on the counter substrate 20 so as to correspond to one pixel. Alternatively, color filter layers can be formed of color resists or so under the pixel electrodes 9*a* opposing to the colors RGB on the TFT array substrate 10. Thus, the efficiency of condensing incident light can be enhanced to realize a bright electrooptic apparatus. Further, a dichroic filter producing the colors RGB may be also formed by utilizing the interference of light rays in such a way that several interference layers having different refractive indices are deposited on the counter substrate 20. According to the counter substrate provided with the dichroic filter, a brighter color electrooptic apparatus can be realized.

(Exemplary Embodiment of Electronic Equipment)

Figure 14:
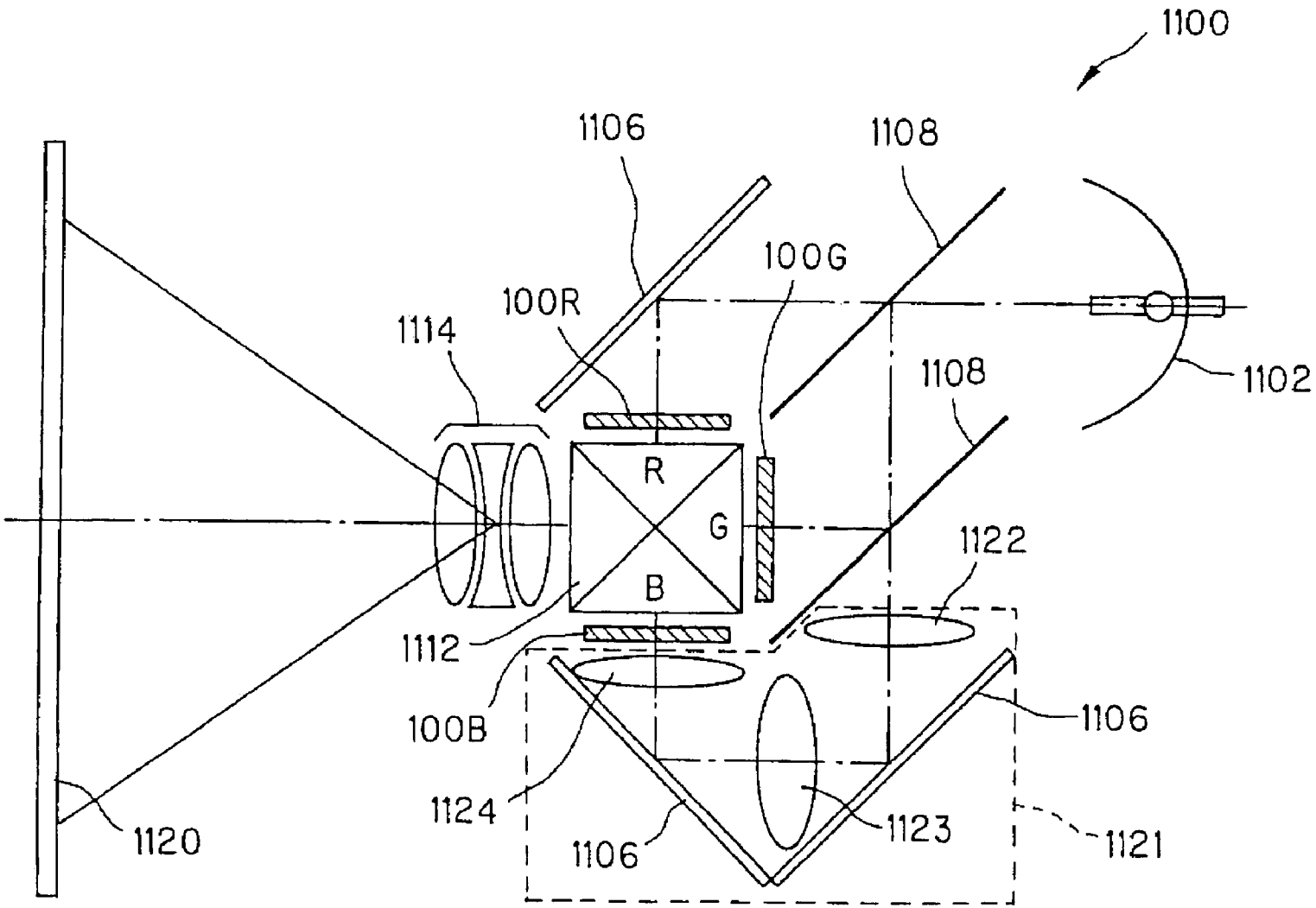
FIG. 14 is a schematic sectional view showing a color liquid-crystal projector which is an example of a projection type color display apparatus as an exemplary embodiment of the electronic equipment of the present invention.

Next, an exemplary embodiment of a projection type color display apparatus as one example of electronic equipment, in which the electrooptic device explained above in detail is employed as a light valve, is described concerning the whole construction thereof, particularly the optical construction thereof. FIG. 14 is a schematic sectional view of the projection type color display apparatus.

Referring to FIG. 14, a liquid crystal projector 1100 which is one example of the projection type color display apparatus in this exemplary embodiment is constructed as a projector in which three liquid crystal modules each including a liquid crystal device 100 with driver circuits mounted on a TFT array substrate are prepared and are respectively employed as light valves 100R, 100G and 100B for the three primary colors RGB. In the liquid crystal projector 1100, when projection light is emitted from a lamp unit 1102 having a white light source such as metal halide lamp, it is decomposed into light components R, G and B respectively corresponding to the three primary colors RGB, by three mirrors 1106 and two dichroic mirrors 1108, and the light components R, G and B are respectively guided to the light valves 100R, 100G and 100B corresponding to respective colors. On this occasion, in order to prevent a light loss ascribable to a long optical path, the light B is especially guided through a relay lens system 1121 which includes an entrance lens 1122, a relay lens 1123 and an exit lens 1124. Subsequently, the light components corresponding to the three primary colors, respectively modulated by the light valves 100R, 100G and 100B are composed again by a dichroic prism 1112. Thereafter, the resulting composed light is projected as a color image on a screen 1120 through a projection lens assembly 1114.

The present invention is not restricted to the exemplary embodiments stated above, and it shall be appropriately alterable within a scope not departing from the purport or idea of the invention read from the claims and the entire specification, and electrooptic devices accompanied by such alterations, driver circuits for them and electronic equipment including them shall also be covered within the technical scope of the present invention.

What is claimed is:

1. An electrooptic device, comprising:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a second displaying electrode disposed above the second substrate so as to oppose the first displaying electrodes;

a sampling circuit including first conductivity type transistors to sample the image signals involving polarity inversion with respect to center voltages of amplitudes of the image signals and feed them to the data lines;

a data line driver circuit that includes a shift register to feed sampling circuit drive signals to gates of the first conductivity type transistors being further formed in the peripheral region;

inverters having output sides connected to the gates of the first conductivity type transistors;

a gate voltage varying unit that changes supply voltages of the inverters in response to the polarity inversion; and the sampling circuit drive signals being inputted to the gates via the inverters.

2. The electrooptic device according to claim 1, the gate voltage varying unit changing-over the gate voltages in response to the polarity inversion so as to equalize writabilities of the first conductivity type transistors between for a positive poiarity of the image signals and for a negative polarity of the image signals.

3. The electrooptic device according to claim 1, the first displaying electrodes including a plurality of pixel electrodes that are insularly disposed in pixel units;

the data lines being electrically connected with the pixel electrodes via the corresponding switching elements; and the second displaying electrode being constructed of a common electrode which opposes to said the plurality of pixel electrodes.

4. The electrooptic device according to claim 3, the plurality of pixel electrodes including a first group of pixel electrodes which are subjected to inversion drive in a first cycle, and a second group of pixel electrodes which are subjected to inversion drive in a second cycle complementary to the first cycle, and the pixel electrodes being arrayed in a plane above the first substrate.

5. The electrooptic device according to claim 1, the same sampling circuit drive signals being fed in parallel to the gates of a plurality of (n) the first conductivity type transistors for every group which includes a predetermined number of m (a natural number m being at least 2 and less than n) such first conductivity type transistors.

6. An electrooptic device, comprising:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a second displaying electrode disposed above the second substrate so as to oppose the first displaying electrodes;

a sampling circuit including first conductivity type transistors to sample the image signals involving polarity inversion with respect to center voltages of amplitudes of the image signals and feed them to the data lines;

a data line driver circuit that includes a shift register to feed sampling circuit drive signals to gates of the first conductivity type transistors being further formed in the peripheral region;

transmission gates that have output sides connected to the gates of the first conductivity type transistors;

gate voltage unit feeding input sides of the transmission gates with voltages which vary in response to the polarity inversion; and the sampling circuit drive signals being inputted to gate control terminals of the transmission gates.

7. An electrooptic device, comprising:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a second displaying electrode disposed above the second substrate so as to oppose the first displaying electrodes;

a sampling circuit including first conductivity type transistors to sample the image signals involving polarity inversion with respect to center voltages of amplitudes of the image signals and feed them to the data lines;

a data line driver circuit that includes a shift register to feed sampling circuit drive signals to gates of the first conductivity type transistors being further formed in the peripheral region;

a gate voltage varying unit that includes a plurality of transmission gates whose output side is connected to the gate of the corresponding first conductivity type transistor and whose gate control terminals are fed with the sampling circuit drive signals, and that one of many differing supply voltages being selected by the plurality of transmission gates so as to be fed as the gate voltage of the corresponding first conductivity type transistor.

8. The electrooptic device according to claim 7, one of many differing supply voltages being fed so as to be shared with a supply voltage for the data line driver circuit, while another being fed via an external circuit connection terminal of the electrooptic device and a wiring line connected thereto.

9. An electrooptic device, comprising:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a sampling circuit including first conductivity type transistors to sample the image signals involving polarity inversion with respect to center voltages of amplitudes of the image signals and feed them to the data lines;

a second displaying electrode disposed above the second substrate so as to oppose the first displaying electrodes;

a gate voltage varying unit that changes gate voltages of the first conductivity type transistors in response to the polarity inversion; and each of the first conductivity type transistors being formed of an N-channel type transistor, and gate voltage for the negative polarity of the polarity inversion being made smaller than the gate voltage for the positive polarity.

10. An electrooptic device, comprising:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a sampling circuit including first conductivity type transistors to sample the image signals involving polarity inversion with respect to center voltages of amplitudes of the image signals and feed them to the data lines;

a second displaying electrode disposed above the second substrate so as to oppose the first displaying electrodes;

a gate voltage varying unit that changes gate voltages of the first conductivity type transistors in response to the polarity inversion; and each of the first conductivity type transistors being formed of a P-channel type transistor, and the gate voltage for the negative polarity of the polarity inversion being made larger than the gate voltage for the positive polarity.

11. A driver circuit for use with an electrooptic device which includes: first and second substrates, an electrooptic substance sandwiched between the first and second substrates, first displaying electrodes disposed above the first substrate, switching elements corresponding to the first displaying electrodes, data lines electrically connected to the switching elements, and a second displaying electrode disposed above the second substrate so as to oppose to the first displaying electrodes, the driver circuit comprising:

a sampling circuit which includes first conductivity type transistors to sample the image signals involving polarity inversion with respect to center voltages of amplitudes of the image signals and feed them to the data lines; and a gate voltage varying unit that changes gate voltages of the first conductivity type transistors in response to the polarity inversion; and each of the first conductivity type transistors being formed of a P-channel type transistor, and the gate voltage for the negative polarity of the polarity inversion being made larger than the gate voltage for the positive polarity.

12. An electronic equipment, comprising:

an electrooptic device which includes:

a first substrate;

a second substrate;

an electrooptic substance sandwiched between the first and second substrates;

first displaying electrodes disposed above the first substrate;

switching elements disposed corresponding to the first displaying electrodes;

data lines electrically connected to the switching elements;

a second displaying electrode disposed above the second substrate so as to oppose the first displaying electrodes;

a sampling circuit that includes first conductivity type transistors to sample the image signals involving polarity inversion with respect to center voltages of amplitudes of the image signals and feed them to the data lines;

a data line driver circuit that includes a shift register to feed sampling circuit drive signals to gates of the first conductivity type transistors being further formed in the peripheral region;

inverters having output sides connected to the gates of the first conductivity type transistors;

a gate voltage varying unit that changes gate voltages of the first conductivity type transistors in response to the polarity inversion, said gate voltage varying unit changing supply voltage of said inverters in response to the polarity inversion; and the sampling circuit drive signals being inputted to the gates via the inverters.

* * * * *